US007509722B2

(12) United States Patent
Shahin et al.

(10) Patent No.: US 7,509,722 B2
(45) Date of Patent: Mar. 31, 2009

(54) POSITIONING AND SPINNING DEVICE

(75) Inventors: David Shahin, Houston, TX (US); Jeff Habetz, Houston, TX (US); Jimmy Lawrence Hollingsworth, LaFayette, LA (US); Bernd Reinholdt, Hannover (DE)

(73) Assignee: Weatherford/Lamb, Inc., Houston, TX (US)

( * ) Notice: Subject to any disclaimer, the term of this patent is extended or adjusted under 35 U.S.C. 154(b) by 0 days.

(21) Appl. No.: 10/382,353

(22) Filed: Mar. 5, 2003

(65) Prior Publication Data

US 2004/0003490 A1 Jan. 8, 2004

Related U.S. Application Data

(63) Continuation-in-part of application No. 09/486,901, filed as application No. PCT/GB98/02582 on Sep. 2, 1998, now Pat. No. 6,591,471.

(30) Foreign Application Priority Data

Sep. 2, 1997 (GB) ..... 9718543.3

(51) Int. Cl.
*B23Q 17/00* (2006.01)
*E21B 19/00* (2006.01)

(52) U.S. Cl. ..... 29/407.09; 29/407.1; 29/407.02; 29/456; 166/85.1; 166/85.5

(58) Field of Classification Search ..... 29/407.09, 29/407.1, 407.2, 709, 456, 407.02; 166/77.51, 166/77.53, 85.1, 85.5; 175/256; 414/22.51
See application file for complete search history.

(56) References Cited

U.S. PATENT DOCUMENTS

| | | | |
|---|---|---|---|
| 122,514 | A | 1/1872 | Bullock |
| 179,973 | A | 7/1876 | Thornton |
| 1,077,772 | A | 11/1913 | Weathersby |

(Continued)

FOREIGN PATENT DOCUMENTS

| | | |
|---|---|---|
| CA | 2 307 386 | 11/2000 |

(Continued)

OTHER PUBLICATIONS

U.S. Appl. No. 09/486,901, filed May 19, 2000, Hollingsworth, et al.

(Continued)

*Primary Examiner*—Essama Omgba
(74) *Attorney, Agent, or Firm*—Patterson & Sheridan, L.L.P.

(57) ABSTRACT

The present invention generally relates to a method and apparatus for connecting a first tubular with a second tubular. The apparatus includes a gripping member for engaging the first tubular and a conveying member for positioning the gripping member. The apparatus also includes a spinner for rotating the first tubular. In one embodiment, the spinner includes a motor and one or more rotational members for engaging the first tubular. In another embodiment, the apparatus includes a rotation counting member biased against the first tubular. In another aspect, the present invention provides a method of connecting a first tubular to second tubular. The method includes engaging the first tubular using a gripping member connected to a conveying member and positioning the gripping member to align the first tubular with the second tubular. Thereafter, the first tubular is engaged with the second tubular, and the first tubular is rotated relative to the second tubular using the gripping member.

17 Claims, 5 Drawing Sheets

U.S. PATENT DOCUMENTS

| | | | | | |
|---|---|---|---|---|---|
| 1,185,582 | A | | 5/1916 | Bignell | |
| 1,301,285 | A | | 4/1919 | Leonard | |
| 1,342,424 | A | | 6/1920 | Cotten | |
| 1,414,207 | A | | 4/1922 | Reed | |
| 1,418,766 | A | | 6/1922 | Wilson | |
| 1,471,526 | A | | 10/1923 | Pickin | |
| 1,585,069 | A | | 5/1926 | Youle | |
| 1,728,136 | A | | 9/1929 | Power | |
| 1,777,592 | A | | 10/1930 | Thomas | |
| 1,805,007 | A | * | 5/1931 | Pedley | 81/57.17 |
| 1,825,028 | A | | 9/1931 | Thomas | |
| 1,830,625 | A | | 11/1931 | Schrock | |
| 1,842,638 | A | | 1/1932 | Wigle | |
| 1,880,218 | A | | 10/1932 | Simmons | |
| 1,917,135 | A | | 7/1933 | Littell | |
| 1,981,525 | A | | 11/1934 | Price | |
| 1,998,833 | A | | 4/1935 | Crowell | |
| 2,017,451 | A | | 10/1935 | Wickersham | |
| 2,049,450 | A | | 8/1936 | Johnson | |
| 2,060,352 | A | | 11/1936 | Stokes | |
| 2,105,885 | A | | 1/1938 | Hindertiter | |
| 2,128,430 | A | | 8/1938 | Pryor | |
| 2,167,338 | A | | 7/1939 | Murcell | |
| 2,184,681 | A | | 12/1939 | Osmun et al. | |
| 2,214,429 | A | | 9/1940 | Miller | |
| 2,216,895 | A | | 10/1940 | Stokes | |
| 2,228,503 | A | | 1/1941 | Boyd et al. | |
| 2,295,803 | A | | 9/1942 | O'Leary | |
| 2,305,062 | A | | 12/1942 | Church et al. | |
| 2,324,679 | A | | 7/1943 | Cox | |
| 2,370,832 | A | | 3/1945 | Baker | |
| 2,379,800 | A | | 7/1945 | Hare | |
| 2,414,719 | A | | 1/1947 | Cloud | |
| 2,499,630 | A | | 3/1950 | Clark | |
| 2,522,444 | A | | 9/1950 | Grable | |
| 2,536,458 | A | * | 1/1951 | Munsinger | 81/57.19 |
| 2,538,458 | A | | 1/1951 | Munsinger | |
| 2,570,080 | A | | 10/1951 | Stone | |
| 2,582,987 | A | | 1/1952 | Hagenbook | |
| 2,590,639 | A | * | 3/1952 | Moser | 534/750 |
| 2,595,902 | A | | 5/1952 | Stone | |
| 2,610,690 | A | | 9/1952 | Beatty | |
| 2,621,742 | A | | 12/1952 | Brown | |
| 2,627,891 | A | | 2/1953 | Clark | |
| 2,641,444 | A | | 6/1953 | Moon | |
| 2,650,314 | A | | 8/1953 | Hennigh et al. | |
| 2,663,073 | A | | 12/1953 | Bieber et al. | |
| 2,668,689 | A | | 2/1954 | Cormany | 255/35 |
| 2,692,059 | A | | 10/1954 | Bolling, Jr. | 214/2.5 |
| 2,720,267 | A | | 10/1955 | Brown | |
| 2,738,011 | A | | 3/1956 | Mabry | |
| 2,741,907 | A | | 4/1956 | Genender et al. | |
| 2,743,087 | A | | 4/1956 | Layne et al. | |
| 2,743,495 | A | | 5/1956 | Eklund | |
| 2,753,744 | A | * | 7/1956 | Therien | 81/57 |
| 2,764,329 | A | * | 9/1956 | Hampton | 224/442 |
| 2,765,146 | A | | 10/1956 | Williams | |
| 2,805,043 | A | | 9/1957 | Williams | |
| 2,850,929 | A | * | 9/1958 | Bolling, Jr. et al. | 81/57.19 |
| 2,953,406 | A | | 9/1960 | Young | |
| 2,965,177 | A | | 12/1960 | Bus, Sr. et al. | |
| 2,978,047 | A | | 4/1961 | DeVaan | |
| 3,006,415 | A | | 10/1961 | Burns et al. | |
| 3,023,651 | A | * | 3/1962 | Wallace | 81/57.18 |
| 3,041,901 | A | | 7/1962 | Knights | |
| 3,054,100 | A | | 9/1962 | Jones | |
| 3,087,546 | A | | 4/1963 | Wooley | |
| 3,090,031 | A | | 5/1963 | Lord | |
| 3,102,599 | A | | 9/1963 | Hillburn | |
| 3,111,179 | A | | 11/1963 | Albers et al. | |
| 3,117,636 | A | | 1/1964 | Wilcox et al. | |
| 3,122,811 | A | | 3/1964 | Gilreath | |
| 3,123,160 | A | | 3/1964 | Kammerer | |
| 3,124,023 | A | | 3/1964 | Marquis et al. | |
| 3,131,769 | A | | 5/1964 | Rochemont | |
| 3,159,219 | A | | 12/1964 | Scott | |
| 3,169,592 | A | | 2/1965 | Kammerer | |
| 3,191,677 | A | | 6/1965 | Kinley | |
| 3,191,680 | A | | 6/1965 | Vincent | |
| 3,191,683 | A | | 6/1965 | Alexander | |
| 3,193,116 | A | | 7/1965 | Kenneday et al. | |
| 3,266,582 | A | | 8/1966 | Homanick | |
| 3,305,021 | A | | 2/1967 | Lebourg | |
| 3,321,018 | A | | 5/1967 | McGill | |
| 3,353,599 | A | | 11/1967 | Swift | |
| 3,380,528 | A | | 4/1968 | Timmons | |
| 3,387,893 | A | | 6/1968 | Hoever | |
| 3,392,609 | A | * | 7/1968 | Bartos | 81/57.19 |
| 3,419,079 | A | | 12/1968 | Current | |
| 3,477,527 | A | * | 11/1969 | Koot | 175/85 |
| 3,489,220 | A | | 1/1970 | Kinley | |
| 3,518,903 | A | | 7/1970 | Ham et al. | 81/57.16 |
| 3,548,936 | A | | 12/1970 | Kilgore et al. | |
| 3,550,684 | A | | 12/1970 | Cubberly, Jr. | |
| 3,552,507 | A | | 1/1971 | Brown | |
| 3,552,508 | A | | 1/1971 | Brown | |
| 3,552,509 | A | | 1/1971 | Brown | |
| 3,552,510 | A | | 1/1971 | Brown | |
| 3,552,848 | A | | 1/1971 | Van Wagner | |
| 3,559,739 | A | | 2/1971 | Hutchison | |
| 3,566,505 | A | | 3/1971 | Martin | |
| 3,570,598 | A | | 3/1971 | Johnson | |
| 3,575,245 | A | | 4/1971 | Cordary et al. | |
| 3,602,302 | A | | 8/1971 | Kluth | |
| 3,603,411 | A | | 9/1971 | Link | |
| 3,603,412 | A | | 9/1971 | Kammerer, Jr. et al. | |
| 3,603,413 | A | | 9/1971 | Grill et al. | |
| 3,606,664 | A | | 9/1971 | Weiner | |
| 3,624,760 | A | | 11/1971 | Bodine | |
| 3,635,105 | A | | 1/1972 | Dickmann et al. | |
| 3,638,989 | A | | 2/1972 | Sandquist | |
| 3,656,564 | A | | 4/1972 | Brown | |
| 3,662,842 | A | | 5/1972 | Bromell | |
| 3,669,190 | A | | 6/1972 | Sizer et al. | |
| 3,680,412 | A | | 8/1972 | Mayer et al. | |
| 3,691,624 | A | | 9/1972 | Kinley | |
| 3,691,825 | A | | 9/1972 | Dyer | |
| 3,692,126 | A | | 9/1972 | Rushing et al. | |
| 3,696,332 | A | | 10/1972 | Dickson, Jr. et al. | |
| 3,697,113 | A | | 10/1972 | Palauro et al. | |
| 3,700,048 | A | | 10/1972 | Desmoulins | |
| 3,706,347 | A | | 12/1972 | Brown | |
| 3,729,057 | A | | 4/1973 | Werner | |
| 3,746,330 | A | | 7/1973 | Taciuk | |
| 3,747,675 | A | | 7/1973 | Brown | |
| 3,760,894 | A | | 9/1973 | Pitifer | |
| 3,776,320 | A | | 12/1973 | Brown | |
| 3,776,991 | A | | 12/1973 | Marcus | |
| 3,780,883 | A | | 12/1973 | Brown | |
| 3,785,193 | A | | 1/1974 | Kinley et al. | |
| 3,808,916 | A | | 5/1974 | Porter et al. | |
| 3,838,613 | A | | 10/1974 | Wilms | 81/57.34 |
| 3,840,128 | A | | 10/1974 | Swoboda, Jr. et al. | 214/1 |
| 3,848,684 | A | | 11/1974 | West | |
| 3,857,450 | A | | 12/1974 | Guier | |
| 3,870,114 | A | | 3/1975 | Pulk et al. | |
| 3,871,618 | A | | 3/1975 | Funk | |
| 3,881,375 | A | | 5/1975 | Kelly | 81/57.35 |
| 3,885,679 | A | | 5/1975 | Swoboda, Jr. et al. | 214/1 |
| 3,892,148 | A | * | 7/1975 | Wiley | 81/57.18 |
| 3,901,331 | A | | 8/1975 | Djurovic | |
| 3,906,820 | A | | 9/1975 | Hauk | |
| 3,913,687 | A | | 10/1975 | Gyongyosi et al. | |
| 3,915,244 | A | | 10/1975 | Brown | |

3,934,660 A 1/1976 Nelson
3,945,444 A 3/1976 Knudson
3,947,009 A 3/1976 Nelmark
3,961,399 A 6/1976 Boyadjieff
3,964,552 A 6/1976 Slator
3,964,556 A 6/1976 Gearhart et al.
3,980,143 A 9/1976 Swartz et al. ..... 173/100
4,049,066 A 9/1977 Richey
4,054,332 A 10/1977 Bryan, Jr.
4,054,426 A 10/1977 White
4,064,939 A 12/1977 Marquis
4,077,525 A 3/1978 Callegari et al. ..... 214/2.5
4,082,017 A * 4/1978 Eckel ..... 81/57.16
4,082,144 A 4/1978 Marquis
4,083,405 A 4/1978 Shirley
4,085,808 A 4/1978 Kling
4,095,865 A 6/1978 Denison et al.
4,100,968 A 7/1978 Delano
4,100,981 A 7/1978 Chaffin
4,127,927 A 12/1978 Hauk et al.
4,133,396 A 1/1979 Tschirky
4,142,739 A 3/1979 Billingsley
4,173,457 A 11/1979 Smith
4,175,619 A 11/1979 Davis
4,186,628 A 2/1980 Bonnice
4,189,185 A 2/1980 Kammerer, Jr. et al.
4,192,206 A * 3/1980 Schulze-Beckinghausen. 81/57.18
4,194,383 A 3/1980 Huzyak ..... 72/245
4,200,010 A 4/1980 Hewitt
4,202,225 A 5/1980 Sheldon et al.
4,212,212 A 7/1980 Chandler et al.
4,221,269 A * 9/1980 Hudson ..... 173/222
4,227,197 A 10/1980 Nimmo et al. ..... 343/878
4,241,878 A 12/1980 Underwood
4,257,442 A 3/1981 Claycomb
4,262,693 A 4/1981 Giebeler
4,274,777 A 6/1981 Scaggs ..... 414/22
4,274,778 A * 6/1981 Putnam et al. ..... 414/22.71
4,277,197 A 7/1981 Bingham ..... 403/104
4,280,380 A 7/1981 Eshghy
4,281,722 A 8/1981 Tucker et al.
4,287,949 A 9/1981 Lindsey, Jr.
4,297,922 A * 11/1981 Higdon ..... 81/57.18
4,311,195 A 1/1982 Mullins, II
4,315,553 A 2/1982 Stallings
4,320,915 A 3/1982 Abbott et al.
4,333,365 A * 6/1982 Perry ..... 51/57.16
4,336,415 A 6/1982 Walling
4,384,627 A 5/1983 Ramirez-Jauregui
4,392,534 A 7/1983 Miida
4,396,076 A 8/1983 Inoue
4,396,077 A 8/1983 Radtke
4,401,000 A 8/1983 Kinzbach
4,407,378 A 10/1983 Thomas
4,408,669 A 10/1983 Wiredal
4,413,682 A 11/1983 Callihan et al.
4,425,827 A * 1/1984 Wells ..... 81/57.19
4,427,063 A 1/1984 Skinner
4,429,753 A * 2/1984 Cushman ..... 173/149
4,437,363 A 3/1984 Haynes
4,440,220 A 4/1984 McArthur ..... 166/85
4,445,734 A 5/1984 Cunningham
4,446,745 A * 5/1984 Stone et al. ..... 73/862.25
4,446,761 A * 5/1984 Boyadjieff et al. ..... 81/57.19
4,449,596 A 5/1984 Boyadjieff
4,460,053 A 7/1984 Jurgens et al.
4,463,814 A 8/1984 Horstmeyer et al.
4,466,498 A 8/1984 Bardwell
4,470,470 A 9/1984 Takano
4,472,002 A 9/1984 Beney et al.
4,474,243 A 10/1984 Gaines
4,478,111 A 10/1984 Wells et al.
4,483,399 A 11/1984 Colgate
4,489,793 A 12/1984 Boren
4,489,794 A 12/1984 Boyadjieff
4,492,134 A 1/1985 Reinholdt et al.
4,494,424 A 1/1985 Bates
4,512,216 A 4/1985 Callegari, Sr. et al.
4,515,045 A * 5/1985 Gnatchenko et al. ..... 81/429
4,529,045 A 7/1985 Boyadjieff et al.
4,544,041 A 10/1985 Rinaldi
4,545,443 A 10/1985 Wiredal
4,570,706 A 2/1986 Pugnet
4,580,631 A 4/1986 Baugh
4,583,603 A 4/1986 Dorleans et al.
4,589,495 A 5/1986 Langer et al.
4,592,125 A 6/1986 Skene
4,593,584 A 6/1986 Neves
4,593,773 A 6/1986 Skeie
4,595,058 A 6/1986 Nations
4,604,724 A 8/1986 Shaginian et al. ..... 364/478
4,604,818 A 8/1986 Inoue
4,605,077 A 8/1986 Boyadjieff
4,605,268 A 8/1986 Meador
4,613,161 A 9/1986 Brisco
4,620,600 A 11/1986 Persson
4,625,796 A 12/1986 Boyadjieff
4,630,691 A 12/1986 Hooper
4,646,827 A 3/1987 Cobb
4,649,777 A 3/1987 Buck
4,651,837 A 3/1987 Mayfield
4,652,195 A 3/1987 McArthur ..... 414/22
4,655,286 A 4/1987 Wood
4,667,752 A 5/1987 Berry et al.
4,671,358 A 6/1987 Lindsey, Jr. et al.
4,676,310 A 6/1987 Scherbatskoy et al.
4,676,312 A 6/1987 Mosing et al.
4,678,031 A 7/1987 Blandford et al.
4,681,158 A 7/1987 Pennison ..... 166/77.5
4,681,162 A 7/1987 Boyd
4,683,962 A 8/1987 True
4,686,873 A 8/1987 Lang et al. ..... 81/57.35
4,691,587 A 9/1987 Farrand et al. ..... 74/493
4,693,316 A 9/1987 Ringgenberg et al.
4,699,224 A 10/1987 Burton
4,709,599 A 12/1987 Buck
4,709,766 A 12/1987 Boyadjieff
4,725,179 A 2/1988 Woolslayer et al. ..... 414/22
4,735,270 A 4/1988 Fenyvesi
4,738,145 A 4/1988 Vincent et al.
4,742,876 A 5/1988 Barthelemy et al.
4,744,426 A 5/1988 Reed
4,759,239 A 7/1988 Hamilton et al.
4,760,882 A 8/1988 Novak
4,762,187 A 8/1988 Haney
4,765,401 A * 8/1988 Boyadjieff ..... 166/77.53
4,765,416 A 8/1988 Bjerking et al.
4,773,689 A 9/1988 Wolters
4,774,861 A * 10/1988 Hamilton et al. ..... 81/57.33
4,775,009 A 10/1988 Wittrisch et al.
4,778,008 A 10/1988 Gonzalez et al.
4,781,359 A 11/1988 Matus
4,788,544 A 11/1988 Howard
4,791,997 A 12/1988 Krasnov
4,793,422 A 12/1988 Krasnov
4,800,968 A 1/1989 Shaw et al.
4,806,928 A 2/1989 Veneruso
4,813,493 A 3/1989 Shaw et al.
4,813,495 A 3/1989 Leach
4,821,814 A 4/1989 Willis et al.
4,825,947 A 5/1989 Mikolajczyk
4,832,552 A 5/1989 Skelly ..... 414/22.54
4,836,064 A 6/1989 Slator
4,836,299 A 6/1989 Bodine
4,842,081 A 6/1989 Parant
4,843,924 A * 7/1989 Hauk ..... 81/57.2

4,843,945 A 7/1989 Dinsdale ..... 81/57.34
4,848,469 A 7/1989 Baugh et al.
4,854,386 A 8/1989 Baker et al.
4,867,236 A 9/1989 Haney et al.
4,875,530 A 10/1989 Frink et al.
4,878,546 A 11/1989 Shaw et al.
4,880,058 A 11/1989 Lindsey et al.
4,883,125 A 11/1989 Wilson et al.
4,899,816 A 2/1990 Mine
4,901,069 A 2/1990 Veneruso
4,904,119 A 2/1990 Legendre et al.
4,909,741 A 3/1990 Schasteen et al.
4,915,181 A 4/1990 Labrosse
4,921,386 A 5/1990 McArthur ..... 414/22.51
4,936,382 A 6/1990 Thomas
4,960,173 A 10/1990 Cognevich et al.
4,962,579 A 10/1990 Moyer et al.
4,962,819 A 10/1990 Bailey et al.
4,962,822 A 10/1990 Pascale
4,971,146 A 11/1990 Terrell
4,997,042 A 3/1991 Jordan et al.
5,009,265 A 4/1991 Bailey et al.
5,022,472 A 6/1991 Bailey et al.
5,027,914 A 7/1991 Wilson
5,036,927 A 8/1991 Willis
5,049,020 A 9/1991 McArthur ..... 414/22.51
5,052,483 A 10/1991 Hudson
5,054,550 A 10/1991 Hodge
5,060,542 A 10/1991 Hauk ..... 81/57.34
5,060,737 A 10/1991 Mohn
5,062,756 A * 11/1991 McArthur et al. ..... 414/22.51
5,069,297 A 12/1991 Krueger
5,074,366 A 12/1991 Karlsson et al.
5,082,069 A 1/1992 Seiler et al.
5,085,273 A 2/1992 Coone
5,096,465 A 3/1992 Chen et al.
5,107,940 A 4/1992 Berry
5,109,924 A 5/1992 Jurgens et al.
5,111,893 A 5/1992 Kvello-Aune
5,141,063 A 8/1992 Quesenbury
RE34,063 E 9/1992 Vincent et al.
5,148,875 A 9/1992 Karlsson et al.
5,150,642 A * 9/1992 Moody et al. ..... 81/57.2
5,156,213 A 10/1992 George et al.
5,160,925 A 11/1992 Dailey et al.
5,168,942 A 12/1992 Wydrinski
5,172,765 A 12/1992 Sas-Jaworsky
5,176,518 A 1/1993 Hordijk et al. ..... 434/37
5,181,571 A 1/1993 Mueller
5,186,265 A 2/1993 Henson et al.
5,191,932 A 3/1993 Seefried et al.
5,191,939 A 3/1993 Stokley
5,197,553 A 3/1993 Letumo
5,207,128 A 5/1993 Albright
5,224,540 A 7/1993 Streich et al.
5,233,742 A 8/1993 Gray et al.
5,234,052 A 8/1993 Coone et al.
5,245,265 A 9/1993 Clay
5,251,709 A 10/1993 Richardson
5,255,741 A 10/1993 Alexander
5,255,751 A 10/1993 Stogner
5,271,468 A 12/1993 Streich et al.
5,271,472 A 12/1993 Leturno
5,272,925 A 12/1993 Henneuse et al.
5,282,653 A 2/1994 LaFleur et al.
5,284,210 A 2/1994 Helms et al.
5,285,008 A 2/1994 Sas-Jaworsky et al.
5,285,204 A 2/1994 Sas-Jaworsky
5,291,956 A 3/1994 Mueller et al.
5,294,228 A 3/1994 Willis et al. ..... 414/22.55
5,297,833 A 3/1994 Willis et al.
5,305,830 A 4/1994 Wittrisch
5,305,839 A 4/1994 Kalsi et al.
5,318,122 A 6/1994 Murray et al.
5,320,178 A 6/1994 Cornette
5,322,127 A 6/1994 McNair et al.
5,323,858 A 6/1994 Jones et al.
5,332,043 A 7/1994 Ferguson
5,332,048 A 7/1994 Underwood et al.
5,340,182 A 8/1994 Busink et al.
5,343,950 A 9/1994 Hale et al.
5,343,951 A 9/1994 Cowan et al.
5,348,095 A 9/1994 Worrall et al.
5,351,582 A * 10/1994 Snyder et al. ..... 81/57.17
5,351,767 A 10/1994 Stogner et al.
5,353,872 A 10/1994 Wittrisch
5,354,150 A 10/1994 Canales ..... 405/154
5,355,967 A 10/1994 Mueller et al.
5,361,859 A 11/1994 Tibbitts
5,368,113 A 11/1994 Schulze-Beckinghausen..175/162
5,375,668 A 12/1994 Hallundbaek
5,379,835 A 1/1995 Streich
5,386,746 A 2/1995 Hauk ..... 81/57.34
5,388,651 A 2/1995 Berry
5,392,715 A 2/1995 Pelrine
5,394,823 A 3/1995 Lenze
5,402,856 A 4/1995 Warren et al.
5,433,279 A 7/1995 Tassari et al.
5,435,400 A 7/1995 Smith
5,452,923 A 9/1995 Smith
5,456,317 A 10/1995 Hood, III et al.
5,458,209 A 10/1995 Hayes et al.
5,461,905 A 10/1995 Penisson
5,472,057 A 12/1995 Winfree
5,477,925 A 12/1995 Trahan et al.
5,494,122 A 2/1996 Larsen et al.
5,497,840 A 3/1996 Hudson
5,501,280 A 3/1996 Brisco
5,501,286 A 3/1996 Berry
5,503,234 A 4/1996 Clanton
5,520,072 A * 5/1996 Perry ..... 81/57.16
5,520,255 A 5/1996 Barr et al.
5,526,880 A 6/1996 Jordan, Jr. et al.
5,535,824 A 7/1996 Hudson
5,535,838 A 7/1996 Keshavan et al.
5,537,900 A * 7/1996 Schaar ..... 81/57.33
5,540,279 A 7/1996 Branch et al.
5,542,472 A 8/1996 Pringle et al.
5,542,473 A 8/1996 Pringle et al.
5,547,029 A 8/1996 Rubbo et al.
5,551,521 A 9/1996 Vail, III
5,553,672 A 9/1996 Smith, Jr. et al.
5,553,679 A 9/1996 Thorp
5,560,437 A 10/1996 Dickel et al.
5,560,440 A 10/1996 Tibbitts
5,566,772 A 10/1996 Coone et al.
5,575,344 A * 11/1996 Wireman ..... 175/85
5,577,566 A 11/1996 Albright et al.
5,582,259 A 12/1996 Barr
5,584,343 A 12/1996 Coone
5,588,916 A 12/1996 Moore
5,613,567 A 3/1997 Hudson
5,615,747 A 4/1997 Vail, III
5,645,131 A 7/1997 Trevisani
5,651,420 A 7/1997 Tibbitts et al.
5,660,087 A 8/1997 Rae
5,661,888 A 9/1997 Hanslik ..... 29/407.02
5,662,170 A 9/1997 Donovan et al.
5,662,182 A 9/1997 McLeod et al.
5,667,011 A 9/1997 Gill et al.
5,667,023 A 9/1997 Harrell et al.
5,667,026 A 9/1997 Lorenz et al. ..... 175/162
5,697,442 A 12/1997 Baldridge
5,706,894 A 1/1998 Hawkins, III
5,706,905 A 1/1998 Barr
5,711,382 A 1/1998 Hansen et al. ..... 175/52

5,717,334 A 2/1998 Vail, III et al.
5,720,356 A 2/1998 Gardes
5,730,471 A 3/1998 Schulze-Beckinghausen et al.
5,732,776 A 3/1998 Tubel et al.
5,735,348 A 4/1998 Hawkins, III
5,735,351 A 4/1998 Helms
5,743,344 A 4/1998 McLeod et al.
5,746,276 A 5/1998 Stuart
5,765,638 A 6/1998 Taylor
5,772,514 A 6/1998 Moore
5,785,132 A * 7/1998 Richardson et al. ..... 175/57
5,785,134 A 7/1998 McLeod et al.
5,787,978 A 8/1998 Carter et al.
5,791,410 A 8/1998 Castille et al.
5,794,703 A 8/1998 Newman et al.
5,803,191 A 9/1998 Mackintosh
5,803,666 A 9/1998 Keller
5,806,589 A 9/1998 Lang
5,813,456 A 9/1998 Milner et al.
5,823,264 A 10/1998 Ringgenberg
5,826,651 A 10/1998 Lee et al.
5,828,003 A 10/1998 Thomeer et al.
5,829,520 A 11/1998 Johnson
5,833,002 A 11/1998 Holcombe
5,836,395 A 11/1998 Budde
5,836,409 A 11/1998 Vail, III
5,839,330 A 11/1998 Stokka
5,839,515 A 11/1998 Yuan et al.
5,839,519 A 11/1998 Spedale, Jr.
5,842,149 A 11/1998 Harrell et al.
5,842,530 A 12/1998 Smith et al.
5,845,722 A 12/1998 Makohl et al.
5,850,877 A 12/1998 Albright et al.
5,860,474 A 1/1999 Stoltz et al.
5,878,815 A 3/1999 Collins
5,887,655 A 3/1999 Haugen et al.
5,887,668 A 3/1999 Haugen et al.
5,890,537 A 4/1999 Lavaure et al.
5,890,549 A 4/1999 Sprehe
5,894,897 A 4/1999 Vail, III
5,907,664 A 5/1999 Wang et al. ..... 395/86
5,908,049 A 6/1999 Williams et al.
5,909,768 A 6/1999 Castille et al.
5,913,337 A 6/1999 Williams et al.
5,921,285 A 7/1999 Quigley et al.
5,921,332 A 7/1999 Spedale, Jr.
5,931,231 A 8/1999 Mock ..... 166/377
5,947,213 A 9/1999 Angle et al.
5,950,742 A 9/1999 Caraway
5,954,131 A 9/1999 Sallwasser
5,957,225 A 9/1999 Sinor
5,960,881 A 10/1999 Allamon et al.
5,971,079 A 10/1999 Mullins
5,971,086 A 10/1999 Bee et al.
5,984,007 A 11/1999 Yuan et al.
5,988,273 A 11/1999 Monjure et al.
6,000,472 A 12/1999 Albright et al.
6,012,529 A 1/2000 Mikolajczyk et al.
6,024,169 A 2/2000 Haugen
6,026,911 A 2/2000 Angle et al.
6,035,953 A 3/2000 Rear
6,056,060 A 5/2000 Abrahamsen et al.
6,059,051 A 5/2000 Jewkes et al.
6,059,053 A 5/2000 McLeod
6,061,000 A 5/2000 Edwards
6,062,326 A 5/2000 Strong et al.
6,065,550 A 5/2000 Gardes
6,070,500 A 6/2000 Dlask et al.
6,070,671 A 6/2000 Cumming et al.
6,079,498 A 6/2000 Lima et al.
6,079,509 A 6/2000 Bee et al.
6,082,461 A 7/2000 Newman et al.
6,089,323 A 7/2000 Newman et al.
6,098,717 A 8/2000 Bailey et al.
6,119,772 A 9/2000 Pruet
6,135,208 A 10/2000 Gano et al.
6,142,545 A 11/2000 Penman et al.
6,155,360 A 12/2000 McLeod
6,158,531 A 12/2000 Vail, III
6,161,617 A 12/2000 Gjedebo
6,170,573 B1 1/2001 Brunet et al.
6,172,010 B1 1/2001 Argillier et al.
6,173,777 B1 1/2001 Mullins
6,179,055 B1 1/2001 Sallwasser et al.
6,182,776 B1 2/2001 Asberg
6,186,233 B1 2/2001 Brunet
6,189,616 B1 2/2001 Gano et al.
6,189,621 B1 2/2001 Vail, III
6,196,336 B1 3/2001 Fincher et al.
6,199,641 B1 3/2001 Downie et al.
6,202,764 B1 3/2001 Ables et al.
6,206,096 B1 * 3/2001 Belik ..... 166/77.51
6,206,112 B1 3/2001 Dickinson, III et al.
6,216,533 B1 4/2001 Woloson et al.
6,217,258 B1 4/2001 Yamamoto et al.
6,220,117 B1 4/2001 Butcher
6,223,823 B1 5/2001 Head
6,227,587 B1 5/2001 Terral
6,234,257 B1 5/2001 Ciglenec et al.
6,237,684 B1 5/2001 Bouligny, Jr. et al.
6,253,845 B1 * 7/2001 Belik ..... 166/77.51
6,263,987 B1 7/2001 Vail, III
6,273,189 B1 8/2001 Gissler et al.
6,275,938 B1 8/2001 Bond et al.
6,276,450 B1 8/2001 Seneviratne
6,279,654 B1 8/2001 Mosing et al.
6,290,432 B1 9/2001 Exley et al.
6,296,066 B1 10/2001 Terry et al.
6,305,469 B1 10/2001 Coenen et al.
6,309,002 B1 10/2001 Bouligny
6,311,792 B1 11/2001 Scott et al.
6,315,051 B1 11/2001 Ayling
6,325,148 B1 12/2001 Trahan et al.
6,330,911 B1 * 12/2001 Allen et al. ..... 166/77.51
6,334,376 B1 1/2002 Torres
6,336,381 B2 * 1/2002 McDonnell ..... 81/57.33
6,343,649 B1 2/2002 Beck et al.
6,347,674 B1 2/2002 Bloom et al.
6,349,764 B1 2/2002 Adams et al.
6,357,485 B2 3/2002 Quigley et al.
6,359,569 B2 3/2002 Beck et al.
6,360,633 B2 3/2002 Pietras
6,367,552 B1 4/2002 Scott et al.
6,367,566 B1 4/2002 Hill
6,371,203 B2 4/2002 Frank et al.
6,374,506 B1 4/2002 Schutte et al.
6,374,924 B1 4/2002 Hanton et al.
6,378,627 B1 4/2002 Tubel et al.
6,378,630 B1 4/2002 Ritorto et al.
6,378,633 B1 4/2002 Moore
6,390,190 B2 5/2002 Mullins
6,392,317 B1 5/2002 Hall et al.
6,397,946 B1 6/2002 Vail, III
6,405,798 B1 6/2002 Barrett et al.
6,408,943 B1 6/2002 Schultz et al.
6,412,554 B1 7/2002 Allen et al.
6,412,574 B1 7/2002 Wardley et al.
6,415,862 B1 7/2002 Mullins
6,419,014 B1 7/2002 Meek et al.
6,419,033 B1 7/2002 Hahn et al.
6,425,709 B1 * 7/2002 Frijns ..... 405/170
6,427,776 B1 8/2002 Hoffman et al.
6,429,784 B1 8/2002 Beique et al.
6,431,626 B1 8/2002 Bouligny
6,443,241 B1 9/2002 Juhasz et al.
6,443,247 B1 9/2002 Wardley 6,446,723 B1 9/2002 Ramons et al.
6,457,532 B1 10/2002 Simpson
6,458,471 B2 10/2002 Lovato et al.
6,464,004 B1 10/2002 Crawford et al.
6,464,011 B2 10/2002 Tubel
6,484,818 B2 11/2002 Alft et al.
6,497,280 B2 12/2002 Beck et al.
6,527,047 B1 3/2003 Pietras
6,527,064 B1 3/2003 Hallundbaek
6,527,493 B1 3/2003 Kamphorst et al.
6,536,520 B1 3/2003 Snider et al.
6,536,522 B2 3/2003 Birckhead et al.
6,536,993 B2 3/2003 Strong et al.
6,538,576 B1 3/2003 Schultz et al.
6,540,025 B2 4/2003 Scott et al.
6,543,552 B1 4/2003 Melcalfe et al.
6,547,017 B1 4/2003 Vail, III
6,553,825 B1 4/2003 Boyd
6,554,064 B1 4/2003 Restarick et al.
6,585,040 B2 7/2003 Hanton et al.
6,591,471 B1 * 7/2003 Hollingsworth et al. .. 29/407.09
6,595,288 B2 7/2003 Mosing et al.
6,619,402 B1 9/2003 Amory et al.
6,622,796 B1 9/2003 Pietras
6,634,430 B2 10/2003 Dawson et al.
6,637,526 B2 * 10/2003 Juhasz et al. ..... 175/52
6,648,075 B2 11/2003 Badrak et al.
6,651,737 B2 11/2003 Bouligny
6,655,460 B2 12/2003 Bailey et al.
6,666,274 B2 12/2003 Hughes
6,668,684 B2 12/2003 Allen et al.
6,668,937 B1 12/2003 Murray
6,679,333 B2 1/2004 York et al.
6,688,394 B1 2/2004 Ayling
6,688,398 B2 2/2004 Pietras
6,691,801 B2 2/2004 Juhasz et al.
6,698,595 B2 3/2004 Norell et al.
6,702,040 B1 3/2004 Sensenig
6,708,769 B2 3/2004 Haugen et al.
6,715,430 B2 4/2004 Choi et al.
6,719,071 B1 4/2004 Moyes
6,722,231 B2 4/2004 Hauk et al.
6,725,924 B2 4/2004 Davidson et al.
6,725,938 B1 4/2004 Pietras
6,725,949 B2 4/2004 Seneviratne
6,732,822 B2 5/2004 Slack et al.
6,742,584 B1 6/2004 Appleton
6,742,596 B2 6/2004 Haugen
6,742,606 B2 6/2004 Melcalfe et al.
6,745,834 B2 6/2004 Davis et al.
6,752,211 B2 6/2004 Dewey et al.
6,832,656 B2 12/2004 Fournier, Jr. et al.
6,832,658 B2 12/2004 Keast
6,837,313 B2 1/2005 Hosie et al.
6,840,322 B2 1/2005 Haynes
6,848,517 B2 2/2005 Wardley
6,854,533 B2 2/2005 Galloway
6,857,486 B2 2/2005 Chitwood et al.
6,857,487 B2 2/2005 Galloway
6,892,835 B2 5/2005 Shahin et al.
6,907,934 B2 6/2005 Kauffman et al.
6,910,402 B2 6/2005 Drzewiecki
6,935,210 B2 8/2005 Hauk et al.
6,938,697 B2 9/2005 Haugen
6,938,709 B2 * 9/2005 Juhasz et al. ..... 175/52
6,976,298 B1 12/2005 Pietras
6,994,176 B2 * 2/2006 Shahin et al. ..... 175/423
7,004,259 B2 * 2/2006 Pietras ..... 166/379
7,028,586 B2 4/2006 Robichaux
7,043,814 B2 * 5/2006 Hollingsworth et al. .. 29/407.09
7,055,594 B1 * 6/2006 Springett et al. ..... 166/85.1
7,073,598 B2 * 7/2006 Haugen ..... 166/380
7,076,852 B2 * 7/2006 Penman et al. ..... 29/426.5
7,090,021 B2 * 8/2006 Pietras ..... 166/380
7,096,977 B2 8/2006 Juhasz et al.
7,100,698 B2 9/2006 Kracik et al.
7,107,875 B2 9/2006 Haugen et al.
7,117,938 B2 10/2006 Hamilton et al.
7,128,161 B2 * 10/2006 Pietras ..... 166/379
7,137,454 B2 * 11/2006 Pietras ..... 166/380
7,140,445 B2 * 11/2006 Shahin et al. ..... 166/380
7,188,547 B1 * 3/2007 West et al. ..... 81/57.16
7,188,686 B2 3/2007 Folk et al.
7,191,686 B1 * 3/2007 Angelle et al. ..... 81/57.34
7,213,656 B2 * 5/2007 Pietras ..... 166/380
7,219,744 B2 * 5/2007 Pietras ..... 166/379
7,281,587 B2 * 10/2007 Haugen ..... 166/380
7,325,610 B2 2/2008 Giroux et al.
2001/0000101 A1 4/2001 Lovato et al.
2001/0002626 A1 6/2001 Frank et al.
2001/0013412 A1 8/2001 Tubel
2001/0040054 A1 11/2001 Haugen et al.
2001/0042625 A1 11/2001 Appleton
2001/0047883 A1 12/2001 Hanton et al.
2002/0029878 A1 3/2002 Victor
2002/0040787 A1 4/2002 Cook et al.
2002/0066556 A1 6/2002 Goode et al.
2002/0074127 A1 6/2002 Birckhead et al.
2002/0074132 A1 6/2002 Juhasz et al.
2002/0079102 A1 6/2002 Dewey et al.
2002/0108748 A1 8/2002 Keyes
2002/0134555 A1 9/2002 Allen et al.
2002/0157829 A1 10/2002 Davis et al.
2002/0162690 A1 11/2002 Hanton et al.
2002/0170720 A1 11/2002 Haugen
2002/0189806 A1 12/2002 Davidson et al.
2002/0189863 A1 12/2002 Wardley
2003/0029641 A1 2/2003 Meehan
2003/0034177 A1 2/2003 Chitwood et al.
2003/0056947 A1 3/2003 Cameron
2003/0056991 A1 3/2003 Hahn et al.
2003/0070841 A1 4/2003 Merecka et al.
2003/0070842 A1 4/2003 Bailey et al.
2003/0111267 A1 6/2003 Pia
2003/0141111 A1 7/2003 Pia
2003/0146023 A1 8/2003 Pia
2003/0155159 A1 8/2003 Slack et al.
2003/0164250 A1 9/2003 Wardley
2003/0164251 A1 9/2003 Tulloch
2003/0164276 A1 9/2003 Snider et al.
2003/0173073 A1 9/2003 Snider et al.
2003/0173090 A1 9/2003 Cook et al.
2003/0213598 A1 11/2003 Hughes
2003/0217865 A1 11/2003 Simpson et al.
2003/0221519 A1 12/2003 Haugen
2004/0000405 A1 1/2004 Fournier, Jr. et al.
2004/0003490 A1 1/2004 Shahin et al.
2004/0003944 A1 1/2004 Vincent et al.
2004/0011534 A1 1/2004 Simonds et al.
2004/0016575 A1 1/2004 Shahin et al.
2004/0060697 A1 4/2004 Tilton et al.
2004/0069500 A1 4/2004 Haugen
2004/0069501 A1 4/2004 Haugen et al.
2004/0079533 A1 4/2004 Buytaert et al.
2004/0108142 A1 6/2004 Vail, III
2004/0112603 A1 6/2004 Galloway et al.
2004/0112646 A1 6/2004 Vail
2004/0118613 A1 6/2004 Vail
2004/0118614 A1 6/2004 Galloway et al.
2004/0123984 A1 7/2004 Vail
2004/0124010 A1 7/2004 Galloway et al.
2004/0124011 A1 7/2004 Gledhill et al.
2004/0124015 A1 7/2004 Vaile et al.
2004/0129456 A1 7/2004 Vail
2004/0140128 A1 7/2004 Vail
2004/0144547 A1 7/2004 Koithan et al.

| | | | |
|---|---|---|---|
| 2004/0173358 | A1 | 9/2004 | Haugen |
| 2004/0216892 | A1 | 11/2004 | Giroux et al. |
| 2004/0216924 | A1 | 11/2004 | Pietras et al. |
| 2004/0216925 | A1 | 11/2004 | Metcalfe et al. |
| 2004/0221997 | A1 | 11/2004 | Giroux et al. |
| 2004/0226751 | A1 | 11/2004 | McKay et al. |
| 2004/0244992 | A1 | 12/2004 | Carter et al. |
| 2004/0245020 | A1 | 12/2004 | Giroux et al. |
| 2004/0251025 | A1 | 12/2004 | Giroux et al. |
| 2004/0251050 | A1 | 12/2004 | Shahin et al. |
| 2004/0251055 | A1 | 12/2004 | Shahin et al. |
| 2004/0262013 | A1 | 12/2004 | Tilton et al. |
| 2005/0000691 | A1 | 1/2005 | Giroux et al. |
| 2005/0051343 | A1 | 3/2005 | Pietras et al. |
| 2005/0096846 | A1 | 5/2005 | Koithan et al. |
| 2005/0098352 | A1 | 5/2005 | Beierbach et al. |
| 2006/0000600 | A1 | 1/2006 | Pietras |
| 2006/0124353 | A1 | 6/2006 | Juhasz et al. |
| 2006/0180315 | A1 | 8/2006 | Shahin et al. |
| 2007/0000668 | A1 | 1/2007 | Christensen |

FOREIGN PATENT DOCUMENTS

| | | |
|---|---|---|
| CA | 2 335 192 | 11/2001 |
| DE | 3 213 464 | 10/1983 |
| DE | 3 523 221 | 2/1987 |
| DE | 3 918 132 | 12/1989 |
| DE | 4 133 802 | 10/1992 |
| EP | 0 087 373 | 8/1983 |
| EP | 0 162 000 | 11/1985 |
| EP | 0 171 144 | 2/1986 |
| EP | 0 235 105 | 9/1987 |
| EP | 0 265 344 | 4/1988 |
| EP | 0 285 386 | 10/1988 |
| EP | 0 426 123 | 5/1991 |
| EP | 0 462 618 | 12/1991 |
| EP | 0 474 481 | 3/1992 |
| EP | 0479583 | 4/1992 |
| EP | 0 525 247 | 2/1993 |
| EP | 0 554 568 | 8/1993 |
| EP | 0 589 823 | 3/1994 |
| EP | 0 659 975 | 6/1995 |
| EP | 0 790 386 | 8/1997 |
| EP | 0 881 354 | 4/1998 |
| EP | 0 571 045 | 8/1998 |
| EP | 0 961 007 | 12/1999 |
| EP | 0 962 384 | 12/1999 |
| EP | 1 006 260 | 6/2000 |
| EP | 1 050 661 | 11/2000 |
| EP | 1148206 | 10/2001 |
| EP | 1 256 691 | 11/2002 |
| FR | 2053088 | 7/1970 |
| FR | 2 053 088 | 10/1973 |
| FR | 2741907 | 6/1997 |
| FR | 2 841 293 | 12/2003 |
| GB | 540 027 | 10/1941 |
| GB | 709 365 | 5/1954 |
| GB | 716 761 | 10/1954 |
| GB | 7 928 86 | 4/1958 |
| GB | 8 388 33 | 6/1960 |
| GB | 881 358 | 11/1961 |
| GB | 9 977 21 | 7/1965 |
| GB | 1 277 461 | 6/1972 |
| GB | 1 306 568 | 3/1973 |
| GB | 1 448 304 | 9/1976 |
| GB | 1 469 661 | 4/1977 |
| GB | 1 582 392 | 1/1981 |
| GB | 2 053 088 | 2/1981 |
| GB | 2 115 940 | 9/1983 |
| GB | 2 170 528 | 8/1986 |
| GB | 2 201 912 | 9/1988 |
| GB | 2 216 926 | 10/1989 |
| GB | 2 223 253 | 4/1990 |
| GB | 2 224 481 | 9/1990 |
| GB | 2 240 799 | 8/1991 |
| GB | 2 275 486 | 4/1993 |
| GB | 2 294 715 | 8/1996 |
| GB | 2 313 860 | 2/1997 |
| GB | 2 320 270 | 6/1998 |
| GB | 2 324 108 | 10/1998 |
| GB | 2 333 542 | 7/1999 |
| GB | 2 335 217 | 9/1999 |
| GB | 2 345 074 | 6/2000 |
| GB | 2 348 223 | 9/2000 |
| GB | 2347445 | 9/2000 |
| GB | 2 349 401 | 11/2000 |
| GB | 2 350 137 | 11/2000 |
| GB | 2 357 101 | 6/2001 |
| GB | 2 357 530 | 6/2001 |
| GB | 2 352 747 | 7/2001 |
| GB | 2 365 463 | 2/2002 |
| GB | 2 372 271 | 8/2002 |
| GB | 2 372 765 | 9/2002 |
| GB | 2 382 361 | 5/2003 |
| GB | 2381809 | 5/2003 |
| GB | 2 386 626 | 9/2003 |
| GB | 2 389 130 | 12/2003 |
| JP | 2001-173349 | 6/2001 |
| RU | 2 079 633 | 5/1997 |
| SU | 112631 | 1/1956 |
| SU | 659260 | 4/1967 |
| SU | 247162 | 5/1967 |
| SU | 395557 | 12/1971 |
| SU | 415346 | 3/1972 |
| SU | 481689 | 6/1972 |
| SU | 461218 | 4/1973 |
| SU | 501139 | 12/1973 |
| SU | 585266 | 7/1974 |
| SU | 583278 | 8/1974 |
| SU | 601390 | 1/1976 |
| SU | 581283 | 2/1976 |
| SU | 655843 | 3/1977 |
| SU | 781312 | 3/1978 |
| SU | 899820 | 6/1979 |
| SU | 955765 | 2/1981 |
| SU | 1304470 | 8/1984 |
| SU | 1618870 | 1/1991 |
| SU | 1808972 | 5/1991 |
| WO | WO 90/06418 | 6/1990 |
| WO | WO 91/16520 | 10/1991 |
| WO | WO 92/01139 | 1/1992 |
| WO | WO 92/18743 | 10/1992 |
| WO | WO 92/20899 | 11/1992 |
| WO | WO 93/07358 | 4/1993 |
| WO | WO 93/24728 | 12/1993 |
| WO | WO 95/10686 | 4/1995 |
| WO | WO 96/18799 | 6/1996 |
| WO | WO 96/28635 | 9/1996 |
| WO | WO 97/05360 | 2/1997 |
| WO | WO 97/08418 | 3/1997 |
| WO | WO 88/01651 | 1/1998 |
| WO | WO 98/05844 | 2/1998 |
| WO | WO 98/09053 | 3/1998 |
| WO | WO 98/11322 | 3/1998 |
| WO | WO 98/32948 | 7/1998 |
| WO | WO 98/55730 | 12/1998 |
| WO | WO 99/04135 | 1/1999 |
| WO | WO 99/11902 | 3/1999 |
| WO | WO 99/23354 | 5/1999 |
| WO | WO 99/24689 | 5/1999 |
| WO | WO 99/35368 | 7/1999 |
| WO | WO 99/37881 | 7/1999 |
| WO | WO 99/41485 | 8/1999 |
| WO | WO 99/50528 | 10/1999 |
| WO | WO 99/58810 | 11/1999 |
| WO | WO 99/64713 | 12/1999 |

| | | |
|---|---|---|
| WO | WO 00/04269 | 1/2000 |
| WO | WO 00/05483 | 2/2000 |
| WO | WO 00/08293 | 2/2000 |
| WO | WO 00/09853 | 2/2000 |
| WO | WO 00/11309 | 3/2000 |
| WO | WO 00/11310 | 3/2000 |
| WO | WO 00/11311 | 3/2000 |
| WO | WO 00/28188 | 5/2000 |
| WO | WO 00/37766 | 6/2000 |
| WO | WO 00/37771 | 6/2000 |
| WO | WO 00/39429 | 7/2000 |
| WO | WO 00/39430 | 7/2000 |
| WO | WO 00/41487 | 7/2000 |
| WO | WO 00/46484 | 8/2000 |
| WO | WO 00/50730 | 8/2000 |
| WO | WO 00/66879 | 11/2000 |
| WO | WO 01/12946 | 2/2001 |
| WO | WO 01/33033 | 5/2001 |
| WO | WO 01/46550 | 6/2001 |
| WO | WO 01/79650 | 10/2001 |
| WO | WO 01/81708 | 11/2001 |
| WO | WO 01/83932 | 11/2001 |
| WO | WO 01/94738 | 12/2001 |
| WO | WO 01/94739 | 12/2001 |
| WO | WO 02/14649 | 2/2002 |
| WO | WO 02/44601 | 6/2002 |
| WO | WO 02/081863 | 10/2002 |
| WO | WO 02/086287 | 10/2002 |
| WO | WO 03/006790 | 1/2003 |
| WO | WO 03/074836 | 9/2003 |
| WO | WO 03/087525 | 10/2003 |
| WO | WO 2004/022903 | 3/2004 |
| WO | WO 2005/090740 | 9/2005 |

OTHER PUBLICATIONS

Hahn, et al., "Simultaneous Drill and Case Technology—Case Histories, Status and Options for Further Development," Society of Petroleum Engineers, IADC/SPE Drilling Conference, New Orlean, LA Feb. 23-25, 2000 pp. 1-9.
M.B. Stone and J. Smith, "Expandable Tubulars and Casing Drilling are Options" Drilling Contractor, Jan./Feb. 2002, pp. 52.
M. Gelfgat, "Retractable Bits Development and Application" Transactions of the ASME, vol. 120, Jun. (1998), pp. 124-130.
"First Success with Casing-Drilling" Word Oil, Feb. 1999, pp. 25.
Dean E. Gaddy, Editor, "Russia Shares Technical Know-How with U.S." Oil & Gas Journal, Mar. 1999, pp. 51-52 and 54-56.
U.S. Appl. No. 10/794,800, filed Mar. 5, 2004.
U.S. Appl. No. 10/832,804, filed Apr. 27, 2004.
U.S. Appl. No. 10/795,214, filed Mar. 5, 2004.
U.S. Appl. No. 10/794,795, filed Mar. 5, 2004.
U.S. Appl. No. 10/755,048, filed Feb. 9, 2004.
U.S. Appl. No. 10/775,048, filed Feb. 2, 2004.
U.S. Appl. No. 10/788,976. filed Feb. 27, 2004.
U.S. Appl. No. 10/794,797, filed Mar. 5, 2004.
U.S. Appl. No. 10/767,322, filed Jan. 29, 2004.
U.S. Appl. No. 10/795,129, filed Mar. 5, 2004.
U.S. Appl. No. 10/794,790, filed Mar. 5, 2004.
U.S. Appl. No. 10/162,302, filed Jun. 4, 2004.
Rotary Steerable Technology—Technology Gains Momentum, Oil & Gas Journal, Dec. 28, 1998.
Directional Drilling, M. Mims, World Oil, May 1999, pp. 40-43.
Multilateral Classification System w/Example Applications, Alan MacKenzie & Cliff Hogg, World Oil, Jan. 1999, pp. 55-61.
U.S. Appl. No. 10/618,093, filed Jul. 11, 2003.
U.S. Appl. No. 10/189,570, filed Jul. 6, 2002.
Tarr, et al., "Casing-while-Drilling: The Next Step Change In Well Construction," World Oil, Oct. 1999, pp. 34-40.
De Leon Mojarro, "Breaking A Paradigm: Drilling With Tubing Gas Wells," SPE Paper 40051, SPE Annual Technical Conference and Exhibition, Mar. 3-5, 1998, pp. 465-472.
De Leon Mojarro, "Drilling/Completing With Tubing Cuts Well Costs By 30%," World Oil, Jul. 1998, pp. 145-150.
Littleton, "Refined Slimhole Drilling Technology Renews Operator Interest," Petroleum Engineer International, Jun. 1992, pp. 19-26.
Anon, "Slim Holes Fat Savings," Journal of Petroleum Technology, Sep. 1992, pp. 816-819.
Anon, "Slim Holes, Slimmer Prospect," Journal of Petroleum Technology, Nov. 1995, pp. 949-952.
Vogt, et al., "Drilling Liner Technology For Depleted Reservoir," SPE Paper 36827, SPE Annual Technical Conference and Exhibition, Oct. 22-24, pp. 127-132.
Mojarro, et al., "Drilling/Completing With Tubing Cuts Well Costs By 30%," World Oil, Jul. 1998, pp. 145-150.
Sinor, et al., Rotary Liner Drilling For Depleted Reservoirs, IADC/SPE Paper 39399, IADC/SPE Drilling Conference, Mar. 3-6, 1998, pp. 1-13.
Editor, "Innovation Starts At The Top At Tesco," The American Oil & Gas Reporter, Apr. 1998, p. 65.
Tessari, et al., "Casing Drilling—A Revolutionary Approach To Reducing Well Costs," SPE/IADC Paper 52789, SPE/IADC Drilling Conference, Mar. 9-11, 1999, pp. 221-229.
Silverman, "Novel Drilling Method—Casing Drilling Process Eliminates Tripping String," Petroleum Engineer International, Mar. 1999, p. 15.
Silverman, "Drilling Technology—Retractable Bit Eliminates Drill String Trips," Petroleum Engineer International, Apr. 1999, p. 15.
Laurent, et al., "A New Generation Drilling Rig: Hydraulically Powered and Computer Controlled," CADE/CAODC Paper 99-120, CADE/CAODC Spring Drilling Conference, Apr. 7 & 8, 1999, 14 pages.
Madell, et al., "Casing Drilling An Innovative Approach To Reducing Drilling Costs," CADE/CAODC Paper 99-121, CADE/CAODC Spring Drilling Conference, Apr. 7 & 8, 1999, pp. 1-12.
Tessari, et al., "Focus: Drilling With Casing Promises Major Benefits," Oil & Gas Journal, May 17, 1999, pp. 58-62.
Laurent, et al., "Hydraulic Rig Supports Casing Drilling," World Oil, Sep. 1999, pp. 61-68.
Perdue, et al., "Casing Technology Improves," Hart's E & P, Nov. 1999, pp. 135-136.
Warren, et al., "Casing Drilling Application Design Considerations," IADC/SPE Paper 59179, IADC/SPE Drilling Conference, Feb. 23-25, 2000 pp. 1-11.
Warren, et al., "Drilling Technology: Part I—Casing Drilling With Directional Steering In The U.S. Gulf Of Mexico," Offshore, Jan. 2001, pp. 50-52.
Warren, et al., "Drilling Technology: Part II—Casing Drilling With Directional Steering In The Gulf Of Mexico," Offshore, Feb. 2001, pp. 40-42.
Shepard, et al., "Casing Drilling: An Emerging Technology," IADC/SPE Paper 67731, SPE/IADC Drilling Conference, Feb. 27-Mar. 1, 2001, pp. 1-13.
Editor, "Tesco Finishes Field Trail Program," Drilling Contractor, Mar./Apr. 2001, P. 53.
Warren, et al., "Casing Drilling Technology Moves To More Challenging Application," AADE Paper 01-NC-HO-32, AADE National Drilling Conference, Mar. 27-29, 2001, pp. 1-10.
Shephard, et al., "Casing Drilling: An Emerging Technology," SPE Drilling & Completion, Mar. 2002, pp. 4-14.
Shephard, et al., "Casing Drilling Successfully Applied In Southern Wyoming," World Oil, Jun. 2002, pp. 33-41.
Forest, et al., "Subsea Equipment For Deep Water Drilling Dual Gradient Mud System," SPE/IADC Drilling Conference, Amsterdam, The Netherlands, Feb. 27, 2001-Mar. 1, 2001, 8 pages.
World's First Drilling With Casing Operation From A Floating Drilling Unit, Sep. 2003, 1 page.
Filippov, et al., "Expandable Tubular Solutions," SPE paper 56500, SPE Annual Technical Conference And Exhibition, Oct. 3-6, 1999, pp. 1-16.
Coronado, et al., "Development Of A One-Trip ECP Cement Inflation And Stage Cementing System For Open Hole Completions," IADC/SPE Paper 39345, IADC/SPE Drilling Conference, Mar. 3-6, 1998, pp. 473-481.
Coronado, et al., "A One-Trip External-Casing-Packer Cement-Inflation And Stage-Cementing System," Journal Of Petroleum Technology, Aug. 1998, pp. 76-77.

Quigley, "Coiled Tubing And Its Applications," SPE Short Course, Houston, Texas, Oct. 3, 1999, 9 pages.
Bayfiled, et al., "Burst And Collapse Of A Sealed Multilateral Junction: Numerical Simulations," SPE/IADC Paper 52873, SPE/IADC Drilling Conference, Mar. 9-11, 1999, 8 pages.
Marker, et al. "Anaconda: Joint Development Project Leads To Digitally Controlled Composite Coiled Tubing Drilling System," SPE paper 60750, SPE/ICOTA Coiled Tubing Roundtable, Apr. 5-6, 2000, pp. 1-9.
Cales, et al., Subsidence Remediation—Extending Well Life Through The Use Of Solid Expandable Casing Systems, AADE Paper 01-NC-HO-24, American Association of Drilling Engineers, Mar. 2001 Conference, pp. 1-16.
Coats, et al., "The Hybrid Drilling Unite: An Overview Of an Integrated Composite Coiled Tubing And Hydraulic Workover Drilling System," SPE Paper 74349, SPE International Petroleum Conference And Exhibition, Feb. 10-12, 2002, pp. 1-7.
Sander, et al., "Project Management And Technology Provide Enhanced Performance For Shallow Horizontal Wells," IADC/SPE Paper 74466, IADC/SPE Drilling Conference, Feb. 26-28, 2002, pp. 1-9.
Coats, et al., "The Hybrid Drilling System: Incorporating Composite Coiled Tubing And Hydraulic Workover Technologies Into One Integrated Drilling System," IADC/SPE Paper 74538, IADC/SPE Drilling Conference, Feb. 26-28, 2002, pp. 1-7.
Galloway, "Rotary Drilling With Casing—A Field Proven Method Of Reducing Wellbore Construction Cost," Paper WOCD-0306092, World Oil Casing Drilling Technical Conference, Mar. 6-7, 2003, pp. 1-7.
Fontenot, et al., "New Rig Design Enhances Casing Drilling Operations In Lobo Trend," paper WOCD-0306-04, World Oil Casing Drilling Technical Conference, Mar. 6-7, 2003, pp. 1-13.
McKay, et al., "New Developments In The Technology Of Drilling With Casing: Utilizing A Displaceable DrillShoe Tool," Paper WOCD-0306-05, World Oil Casing Drilling Technical Conference, Mar. 6-7, 2003, pp. 1-11.
Sutriono—Santos, et al., "Drilling With Casing Advances To Floating Drilling Unit With Surface BOP Employed," Paper WOCD-0307-01, World Oil Casing Drilling Technical Conferece, Mar. 6-7, 2003, pp. 1-7.
Vincent, et al., "Liner And Casing Drilling—Case Histories And Technology," Paper WOCD-0307-02, World Oil Casing Drilling Technical Conference, Mar. 6-7, 2003, pp. 1-20.
Maute, "Electrical Logging: State-of-the Art," The Log Analyst, May-Jun. 1992, pp. 206-227.
Tessari, et al., "Retrievable Tools Provide Flexibility for Casing Drilling," Paper No. WOCD-0306-01, World Oil Casing Drilling Technical Conference, 2003, pp. 1-11.
Evans, et al., "Development And Testing Of An Economical Casing Connection For Use In Drilling Operations," paper WOCD-0306-03, World Oil Casing Drilling Technical Conference, Mar. 6-7, 2003, pp. 1-10.
Dennis L. Bickford and Mark J. Mabile, Casing Drilling Rig Selection For Stratton Field, Texas, World Oil, vol. 226 No., Mar. 2005.
Alexander Sas-Jaworsky and J. G. Williams, Development of Composite Coiled Tubing For Oilfield Services, SPE 26536, Society of Petroleum Engineers, Inc., 1993.
A. S. Jafar, H.H. Al-Attar and I. S. El-Ageli, Discussion and Comparison of Performance of Horizontal Wells in Bouri Field, SPE 26927, Society of Petroleum Engineers, Inc. 1996.
G. F. Boykin, The Role of A Worldwide Drilling Organization and the Road to the Future, SPE/IADC 37630, 1997.
M. S. Fuller, M. Littler, and I. Pollock, Innovative Way To Cement a Liner Utilizing a New Inner String Liner Cementing Process, 1998.
Helio Santos, Consequences and Relevance of Drillstring Vibration on Wellbore Stability, SPE/IADC 52820, 1999.
Chan L. Daigle. Donald B. Campo. Carey J. Naquin. Rudy Cardenas. Lev M. Ring, Patrick L. York, Expandable Tubulars: Field Examples of Application in Well Construction and Remediation, SPE 62958, Society of Petroleum Engineers Inc., 2000.
C. Lee Lohoefer, Ben Mathis, David Brisco, Kevin Waddell, Lev Ring, and Patrick York, Expandable Liner Hanger Provides Cost-Effective Alternative Solution, IADC/SPE 59151, 2000.
Kenneth K. Dupal, Donald B. Campo, John E. Lofton, Don Weisinger, R. Lance Cook, Michael D. Bullock, Thomas P. Grant, and Patrick L. York, Solid Expandable Tubular Technology—A Year of Case Histories in the Drilling Environment, SPE/IADC 67770, 2001.
Mike Bullock, Tom Grant, Rick Sizemore, Chan Daigle, and Pat York, Using Expandable Solid Tubulars To Solve Well Construction Challenges In Deep Waters And Maturing Properities, IBP 27500, Brazilian Petroleum Institute—IBP, 2000.
Coiled Tubing Handbook, World Oil, Gulf Publishing Company, 1993.
G H. Kamphorst, G. L. Van Wechem, W. Boom, D. Bottger, and K. Koch, Casing Running Tool, SPE/IADC 52770.
Detlef Hahn, Friedhelm Makohl, and Larry Watkins, Casing-While Drilling System Reduces Hole Collapse Risks, Offshore, pp. 54, 56, and 59, Feb. 1998.
Yakov A. Gelfgat, Mikhail Y. Gelfgat and Yuri S. Lopatin, Retractable Drill Bit Technology—Drilling Without Pulling Out Drillpipe, Advanced Drilling Solutions Lessons From the FSU; Jun. 2003; vol. 2, pp. 351-464.
Tommy Warren, SPE, Bruce Houtchens, SPE, Garret Madell, SPE, Directional Drilling With Casing, SPE/IADC 79914, Tesco Corporation, SPE/IADC Drilling Conference 2003.
LaFleur Petroleum Services, Inc., "Autoseal Circulating Head," Engineering Manufacturing, 1992, 11 Pages.
Valves Wellhead Equipment Saftey Systems, W-K-M Division, ACF Industries, Catalog 80, 1980, 5 Pages.
Canrig Top Drive Drilling Systems, Harts Petroleum Engineer International, Feb. 1997, 2 Pages.
The Original Portable Top Drive Drilling System, TESCO Drilling Technology, 1997.
Mike Killalea, Portable Top Drives: What's Driving The Market?, IADC, Drilling Contractor, Sep. 1994, 4 Pages.
500 or 650 ECIS Top Drive, Advanced Permanent Magnet Motor Technology, TESCO Drilling Technology, Apr. 1998, 2 Pages.
500 or 650 HCIS Top Drive, Powerful Hydraulic Compact Top Drive Drilling System, TESCO Drilling Technology, Apr. 1998, 2 Pages.
Product Information (Sections 1-10) Canrig Drilling Technology, Ltd., Sep. 18, 1996.

* cited by examiner

POSITIONING AND SPINNING DEVICE

CROSS-REFERENCE TO RELATED APPLICATIONS

This application is a continuation-in-part of U.S. patent application Ser. No. 09/486,901, filed on May 19, 2000 now U.S. Pat. No. 6,591,471, which is the National Stage of International Application No. PCT/GB98/02582, filed on Sep. 2, 1998, and published under PCT article 21(2) in English, which claims priority of United Kingdom Application No. 9718543.3, filed on Sep. 2, 1997. Each of the aforementioned related patent applications is herein incorporated by reference in its entirety.

BACKGROUND OF THE INVENTION

1. Field of the Invention

The present invention relates to methods and apparatus for connecting tubulars. Particularly, the invention relates an apparatus for aligning and rotating tubulars for connection therewith.

2. Description of the Related Art

In well completion operations, a wellbore is formed to access hydrocarbon-bearing formations by the use of drilling. Drilling is accomplished by utilizing a drill bit that is mounted on the end of a drill support member, commonly known as a drill string. To drill within the wellbore to a predetermined depth, the drill string is often rotated by a top drive or rotary table on a surface platform or rig, or by a downhole motor mounted towards the lower end of the drill string. After drilling to a predetermined depth, the drill string and drill bit are removed and a section of casing is lowered into the wellbore. An annular area is thus formed between the string of casing and the formation. The casing string is temporarily hung from the surface of the well. A cementing operation is then conducted in order to fill the annular area with cement. Using apparatus known in the art, the casing string is cemented into the wellbore by circulating cement into the annular area defined between the outer wall of the casing and the borehole. The combination of cement and casing strengthens the wellbore and facilitates the isolation of certain areas of the formation behind the casing for the production of hydrocarbons.

It is common to employ more than one string of casing in a wellbore. In this respect, one conventional method to complete a well includes drilling to a first designated depth with a drill bit on a drill string. Then, the drill string is removed and a first string of casing is run into the wellbore and set in the drilled out portion of the wellbore. Cement is circulated into the annulus behind the casing string and allowed to cure. Next, the well is drilled to a second designated depth, and a second string of casing, or liner, is run into the drilled out portion of the wellbore. The second string is set at a depth such that the upper portion of the second string of casing overlaps the lower portion of the first string of casing. The second string is then fixed, or "hung" off of the existing casing by the use of slips, which utilize slip members and cones to wedgingly fix the second string of casing in the wellbore. The second casing string is then cemented. This process is typically repeated with additional casing strings until the well has been drilled to a desired depth. Therefore, two run-ins into the wellbore are required per casing string to set the casing into the wellbore. In this manner, wells are typically formed with two or more strings of casing of an ever-decreasing diameter.

As more casing strings are set in the wellbore, the casing strings become progressively smaller in diameter in order to fit within the previous casing string. In a drilling operation, the drill bit for drilling to the next predetermined depth must thus become progressively smaller as the diameter of each casing string decreases in order to fit within the previous casing string. Therefore, multiple drill bits of different sizes are ordinarily necessary for drilling in well completion operations.

Another method of performing well completion operations involves drilling with casing, as opposed to the first method of drilling and then setting the casing. In this method, the casing string is run into the wellbore along with a drill bit for drilling the subsequent, smaller diameter hole located in the interior of the existing casing string. The drill bit is operated by rotation of the drill string from the surface of the wellbore. Once the borehole is formed, the attached casing string may be cemented in the borehole. The drill bit is either removed or destroyed by the drilling of a subsequent borehole. The subsequent borehole may be drilled by a second working string comprising a second drill bit disposed at the end of a second casing that is of sufficient size to line the wall of the borehole formed. The second drill bit should be smaller than the first drill bit so that it fits within the existing casing string. In this respect, this method requires at least one run-in into the wellbore per casing string that is set into the wellbore.

It is known in the industry to use top drive systems to rotate a drill string to form a borehole. Top drive systems are equipped with a motor to provide torque for rotating the drilling string. The quill of the top drive is typically threadedly connected to an upper end of the drill pipe in order to transmit torque to the drill pipe. Top drives may also be used in a drilling with casing operation to rotate the casing.

More recently, gripping heads adapted for use with a top drive have been developed to impart torque from the top drive to the casing. Generally, gripping heads are equipped with gripping members to grippingly engage the casing string to transmit torque applied from the top drive to the casing. Gripping heads may include an external gripping device such as a torque head or an internal gripping device such as a spear. An example of a torque head is disclosed in U.S. Pat. No. 6,311,792, issued to Scott et al., which discloses a torque head having slips for engaging an exterior of the casing.

In addition to imparting torque to the casing, the gripping head may also provide a fluid path for fluid circulation during drilling. Generally, gripping heads define a bore therethrough for fluid communication between the top drive and the casing. Additionally, gripping heads may include sealing members to prevent leakage during circulation.

It is typically necessary to raise or lower the top drive during drilling. For example, the top drive is lowered during drilling in order to urge the drill bit into the formation to extend the wellbore. As the wellbore is extended, additional casings must be added to the casing string. The top drive is released from the casing string and raised to a desired height, thereby allowing the make up of the additional casing to the casing string.

Generally, top drives are disposed on rails so that it is movable axially relative to the well center. While the gripping head may rotate relative to the top drive, it is axially fixed relative to the top drive and thus must remain within the same plane as the top drive and well center. Because movement of the torque head and top drive are restricted, a single joint elevator attached to cable bails is typically used to move additional casings from the rack to well center.

Generally, when the casing is transported from the rack to well center, a rig hand is employed to manipulate the cable bails and angle the elevator from its resting position below the gripping head to the rack. The elevator is closed around one end of the casing to retain control of the casing. The top drive is then raised to pull the elevator and the attached casing to well center.

Once the elevator lifts the casing from the rack, the casing is placed in alignment with the casing string held in the wellbore. Typically, this task is also performed by a rig hand. Because the free end of the casing is unsupported, this task generally presents a hazard to the personnel on the rig floor as they try to maneuver the casing above the wellbore.

A pipe handling arm has recently been developed to manipulate a first tubular into alignment with a second tubular, thereby eliminating the need of a rig hand to align the tubulars. The pipe handling arm is disclosed in International Application Number PCT/GB98/02582, entitled "Method and Apparatus for Aligning Tubulars" and published on Mar. 11, 1999, which application is herein incorporated by reference in its entirety. The pipe handling arm includes a positioning head mounted on a telescopic arm which can hydraulically extend, retract, and pivot to position the first tubular into alignment with the second tubular.

Once the casings are in position, the connection is usually made up by utilizing a spinner and a power tong. Generally, spinners are designed to provide low torque while rotating the casing at a high rate. On the other hand, power tongs are designed to provide high torque with a low turn rate, such as a half turn only. While the spinner provides a faster make up rate, it fails to provide enough torque to form a fluid tight connection. Whereas the power tong may provide enough torque, it fails to make up the connection in an efficient manner because the power tong must grip the casing several times to tighten the connection. Furthermore, the action of gripping and releasing the casing repeatedly may damage the casing surface. Therefore, the spinner and the power tong are typically used in combination to make up a connection.

To make up the connection, the spinner and the power tong are moved from a location on the rig floor to a position near the well center to rotate the casing into engagement with the casing string. Thereafter, the spinner is actuated to perform the initial make up of the connection. Then, the power tong is actuated to finalize the connection. Because operating time for a rig is very expensive, some as much as $500,000 per day, there is enormous pressure to reduce the time they are used in the formation of the wellbore.

There is a need, therefore, for methods and apparatus to reduce the time it takes to make up a tubular connection. There is also a need for an apparatus for aligning tubulars for connection therewith and partly make up the connection while the power tong is moved into position.

SUMMARY OF THE INVENTION

The present invention generally relates to a method and apparatus for connecting a first tubular with a second tubular. The apparatus includes a gripping member for engaging the first tubular and a conveying member for positioning the gripping member. The apparatus also includes a spinner for rotating the first tubular. In one embodiment, the spinner includes a motor and one or more rotational members for engaging the first tubular. In another embodiment, the apparatus includes a rotation counting member biased against the first tubular.

In another aspect, the present invention provides a method of connecting a first tubular to second tubular. The method includes engaging the first tubular using a gripping member connected to a conveying member and positioning the gripping member to align the first tubular with the second tubular. Thereafter, the first tubular is engaged with the second tubular, and the first tubular is rotated relative to the second tubular using the gripping member.

In another embodiment, the method further comprises determining a position of the gripping member, wherein the position of the gripping member aligns the first tubular with the second tubular, and memorizing the position of the gripping member. Additional tubulars may be connected by recalling the memorized position.

In yet another aspect, the present invention provides a top drive system for forming a wellbore with a tubular. The system includes a top drive, a gripping head operatively connected to the top drive, and a pipe handling arm. The arm may include a gripping member for engaging the tubular and a conveying member for positioning the gripping member. The pipe handling arm also includes a spinner for connecting the first tubular to the second tubular. In another embodiment, the system may also include an elevator and one or more bails operatively connecting the elevator to the top drive.

In another aspect still, the present invention provides a method of forming a wellbore with a tubular string having a first tubular and a second tubular. The method includes providing a top drive operatively connected to a gripping head; engaging the first tubular with a pipe handling arm; and engaging the first tubular with the second tubular. Then, the pipe handling arm rotates the first tubular with respect to the second tubular. Thereafter, the gripping head engages the first tubular and the top drive is actuated to rotate tubular string, thereby forming the wellbore.

BRIEF DESCRIPTION OF THE DRAWINGS

So that the manner in which the above recited features of the present invention, and other features contemplated and claimed herein, are attained and can be understood in detail, a more particular description of the invention, briefly summarized above, may be had by reference to the embodiments thereof which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION OF THE PREFERRED EMBODIMENT

Figure 1:
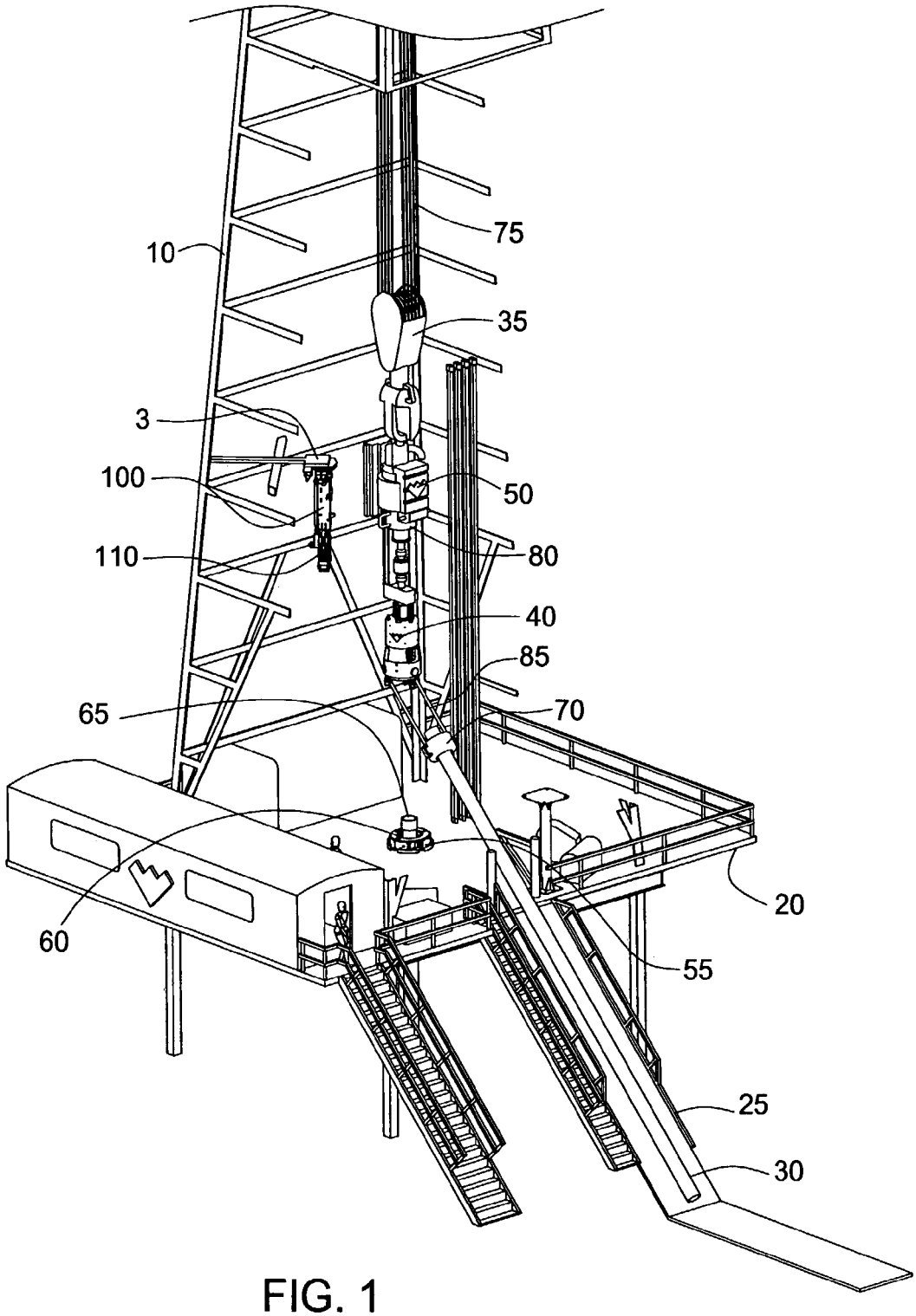
FIG. 1 is a partial view of a rig having a top drive system and a pipe handling arm according to aspects of the present invention.

FIG. 1 shows a drilling rig 10 applicable to drilling with casing operations or a wellbore operation that involves picking up/laying down tubulars. The drilling rig 10 is located above a formation at a surface of a well. The drilling rig 10 includes a rig floor 20 and a v-door (not shown). The rig floor 20 has a hole 55 therethrough, the center of which is termed the well center. A spider 60 is disposed around or within the hole 55 to grippingly engage the casings 30, 65 at various stages of the drilling operation. As used herein, each casing 30, 65 may include a single casing or a casing string having more than one casing, and may include a liner, drill pipe, or other types of wellbore tubulars. Therefore, aspects of the present invention are equally applicable to other types of wellbore tubulars, such as drill pipe and liners.

The drilling rig 10 includes a traveling block 35 suspended by cables 75 above the rig floor 20. The traveling block 35 holds the top drive 50 above the rig floor 20 and may be caused to move the top drive 50 axially. The top drive 50 includes a motor 80 which is used to rotate the casing 30, 65 at various stages of the operation, such as during drilling with casing or while making up or breaking out a connection between the casings 30, 65. A railing system (not shown) is coupled to the top drive 50 to guide the axial movement of the top drive 50 and to prevent the top drive 50 from rotational movement during rotation of the casings 30, 65.

Disposed below the top drive 50 is a gripping head 40. The gripping head 40 is utilized to grip an upper portion of the casing 30. The gripping head 40 may include any suitable gripping head known to a person of ordinary skill in the art. Examples of gripping heads 40 include a torque head and a spear. Generally, a torque head employs gripping members such as slips (not shown) to engage the outer surface of the casing 30. An exemplary torque head which may be used with the present invention is disclosed in U.S. Pat. No. 6,311,792 B1, issued on Nov. 6, 2001 to Scott et al., which is herein incorporated by reference. A spear typically includes a gripping mechanism which has gripping members disposed on its outer perimeter for engaging the inner surface of the casing 30.

An elevator 70 operatively connected to the gripping head 40 may be used to transport the casing 30 from a rack 25 or a pickup/lay down machine to the well center. The elevator 70 may include any suitable elevator known to a person of ordinary skill in the art. The elevator defines a central opening to accommodate the casing 30. In one embodiment, bails 85 are used to interconnect the elevator 70 to the gripping head 40. Preferably, the bails 85 are pivotable relative to the gripping head 40. As shown in FIG. 1, the top drive 50 has been lowered to a position proximate the rig floor 20, and the elevator 70 has been closed around the casing 30 resting on the rack 25. In this position, the casing 30 is ready to be hoisted by the top drive 50.

In one aspect, a tubular positioning device 100 is disposed on a platform 3 of the drilling rig 10. The tubular positioning device 100 may be used to guide and align the casing 30 with the casing string 65 for connection therewith. A suitable tubular positioning device 100 includes the pipe handling arm 100 shown in FIG. 1. The pipe handling arm 100 includes a gripping member 150 for engaging the casing 30 during operation. The pipe handling arm 100 is adapted and designed to move in a plane substantially parallel to the rig floor 20 to guide the casing 30 into alignment with the casing 65 in the spider 60.

Figure 2:
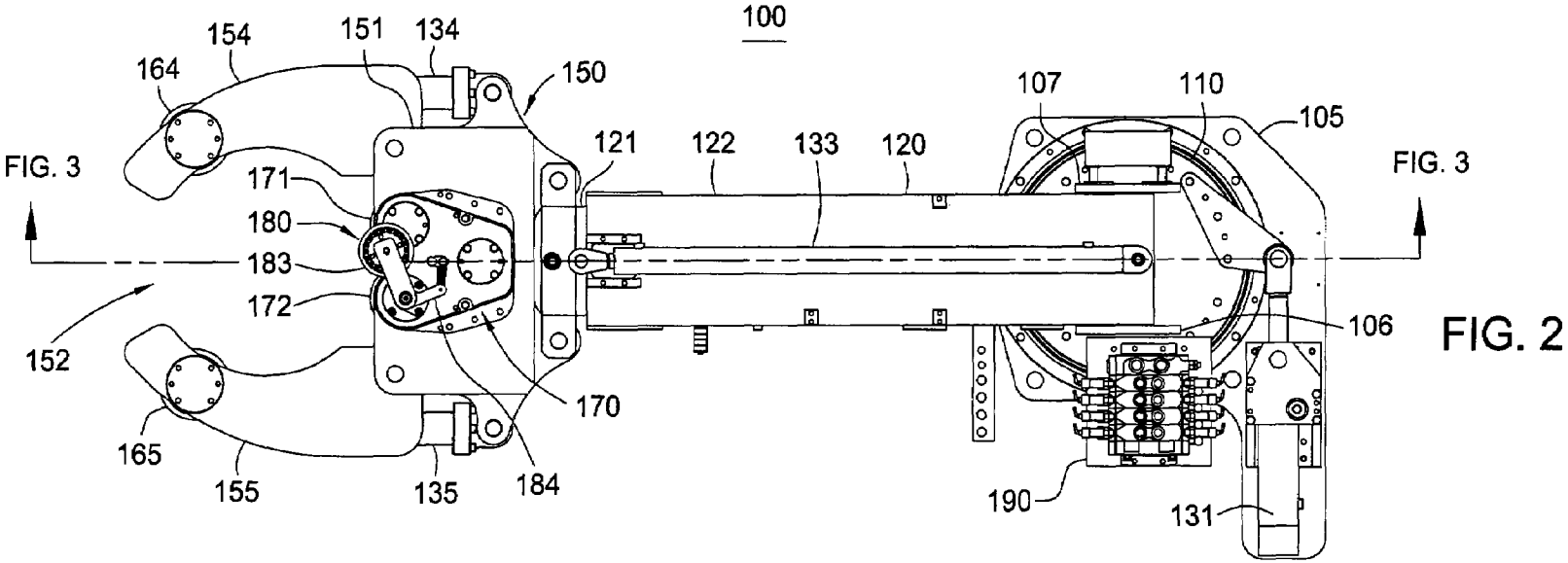
FIG. 2 is a top view of the pipe handling arm shown in FIG. 1.
Figure 3:
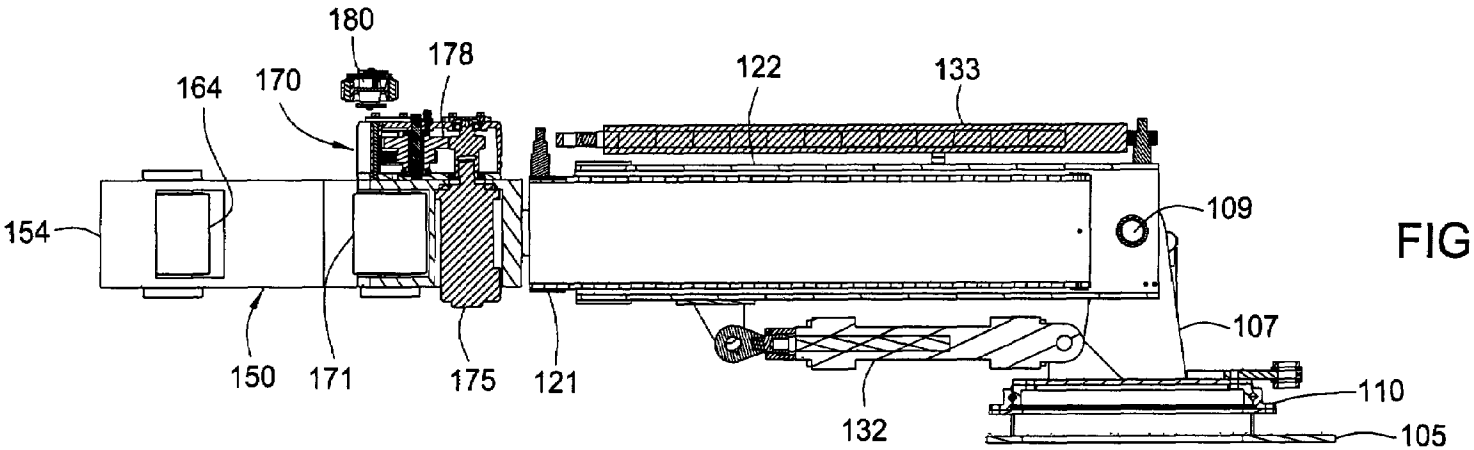
FIG. 3 is a cross-section view of the pipe handling arm along line A-A of FIG. 2.

FIGS. 2-3 depict a pipe handling arm 100 according to aspects of the present invention. FIG. 2 presents a top view of the pipe handling arm 100, while FIG. 3 presents a cross-sectional view of the pipe handling arm 100 along line A-A. The pipe handling arm 100 includes a base 105 at one end for attachment to the platform 3. The gripping member 150 is disposed at another end, or distal end, of the pipe handling arm 100. A rotor 110 is rotatably mounted on the base 105 and may be pivoted with respect to the base 105 by a piston and cylinder assembly 131. One end of the piston and cylinder assembly 131 is connected to the base 105, while the other end is attached to the rotor 110. In this manner, the rotor 110 may be pivoted relative to the base 105 on a plane substantially parallel to the rig floor 20 upon actuation of the piston and cylinder assembly 131.

A conveying member 120 interconnects the gripping member 150 to the rotor 110. In one embodiment, two support members 106, 107 extend upwardly from the rotor 110 and movably support the conveying member 120 on the base 105. Preferably, the conveying member 120 is coupled to the support members 106, 107 through a pivot pin 109 that allows the conveying member 120 to pivot from a position substantially perpendicular to the rig floor 20 to a position substantially parallel to the rig floor 20. Referring to FIG. 3, the conveying member 120 is shown as a telescopic arm. A second piston and cylinder assembly 132 is employed to pivot the telescopic arm 120 between the two positions. The second piston and cylinder assembly 132 movably couples the telescopic arm 120 to the rotor 110 such that actuation of the piston and cylinder assembly 132 raises or lowers the telescopic arm 120 relative to the rotor 110. In the substantially perpendicular position, the pipe handling arm 100 is in an unactuated position, while a substantially parallel position places the pipe handling arm 100 in the actuated position.

The telescopic arm 120 includes a first portion 121 slidably disposed in a second portion 122. A third piston and cylinder assembly 133 is operatively coupled to the first and second portions 121, 122 to extend or retract the first portion 121 relative to the second portion 122. In this respect, the telescopic arm 120 and the rotor 110 allow the pipe handling arm 100 to guide the casing 30 into alignment with the casing 65 in the spider 60 for connection therewith. Although a telescopic arm 120 is described herein, any suitable conveying member known to a person of ordinary skill in the art are equally applicable so long as it is capable of positioning the gripping member 150 at a desired position.

The gripping member 150, also known as the "head," is operatively connected to the distal end of the telescopic arm 120. The gripping member 150 defines a housing 151 movably coupled to two jaws 154, 155. Referring to FIG. 2, a jaw 154, 155 is disposed on each side of the housing 151 in a manner defining an opening 152 for retaining a casing 30. Piston and cylinder assemblies 134, 135 may be employed to actuate the jaws 154, 155. One or more centering members 164, 165 may be disposed on each jaw 154, 155 to facilitate centering of the casing 30 and rotation thereof. An exemplary centering member 164, 165 may include a roller. The rollers 164, 165 may include passive rollers or active rollers having a driving mechanism.

It is understood that the piston and cylinder assemblies 131, 132, 133, 134, and 135 may include any suitable fluid operated piston and cylinder assembly known to a person of ordinary skill in the art. Exemplary piston and cylinder assemblies include a hydraulically operated piston and cylinder assembly and a pneumatically operated piston and cylinder assembly.

In another aspect, the gripping member 150 may be equipped with a spinner 170 to rotate the casing 30 retained by the gripping member 150. As shown in FIG. 3, the spinner 170 is at least partially disposed housing 151. The spinner 170 includes one or more rotational members 171, 172 actuated by a motor 175. The torque generated by the motor 175 is transmitted to a gear assembly 178 to rotate the rotational members 171, 172. Because the rotational members 171, 172 are in frictional contact with the casing 30, the torque is transmitted to the casing 30, thereby causing rotation thereof. In one embodiment, two rotational members 171, 172 are employed and equidistantly positioned relative to a central axis of the gripping member 150. An exemplary rotational member 171 includes a roller. Rotation of the casing 30 will cause the partial make up of the connection between the casings 30, 65. It is understood that the operation may be reversed to break out a tubular connection.

In one aspect, the spinner 170 may be used to perform the initial make up of the threaded connection. The spinner 170 may include any suitable spinner known to a person of ordinary skill in the art. In one embodiment, the spinner 170 may be used to initially make up about 80% or less of a casing connection; preferably, about 70% or less; and most preferably, about 60% or less. In another embodiment, the spinner 170 may be used to initially make up about 95% or less of a drill pipe connection; preferably, about 80% or less; and most preferably, about 70% or less. One advantage of the spinner 170 is that it may rotate the casing 30 at a high speed or continuously rotate the casing 30 to make up the connection. In one embodiment, the spinner 170 may rotate the casing 30 relatively faster than existing top drives or power tongs. Preferably, the spinner 170 may rotate the casing 30 at a rate higher than about 5 rpm; more preferably, higher than about 10 rpm; and most preferably, higher than about 15 rpm. In another embodiment, the spinner 170 may accelerate faster than the top drive 50 or the power tong to rotate the casing 30.

A rotation counting member 180 may optionally be used to detect roller slip. Roller slip is the condition in which the rollers 171, 172 are rotating, but the casing 30 is not. Roller slip may occur when the torque supplied to the rollers 171, 172 cannot overcome the strain in the threaded connection required to further make up the connection. Roller slip may be an indication that the connection is ready for a power tong to complete the make up, or that the connection is damaged, for example, cross-threading. In one embodiment, the rotation counting member 180 includes a circular member 183 biased against the casing 30 by a biasing member 184. Preferably, the circular member 183 is an elastomeric wheel, and the biasing member 184 is a spring loaded lever.

A valve assembly 190 is mounted on the base 105 to regulate fluid flow to actuate the appropriate piston and cylinder assemblies 131, 132, 133, 134, 135. The valve assembly 190 may be controlled from a remote console (not shown) located on the rig floor 20. The remote console may include a joystick which is spring biased to a central, or neutral, position. Manipulation of the joystick causes the valve assembly 190 to direct the flow of fluid to the appropriate piston and cylinder assemblies. The pipe handling arm 100 may be designed to remain in the last operating position when the joystick is released.

In another aspect, the pipe handling arm 100 may include one or more sensors to detect the position of the gripping member 150. In one embodiment, a linear transducer may be employed to provide a signal indicative of the respective extension of piston and cylinder assemblies 131, 133. The linear transducer may be any suitable liner transducer known to a person of ordinary skill in the art, for example, a linear transducer sold by Rota Engineering Limited of Bury, Manchester, England. The detected positions may be stored and recalled to facilitate the movement of the casing 30. Particularly, after the gripping member 150 has place the casing 30 into alignment, the position of the gripping member 150 may be determined and stored. Thereafter, the stored position may be recalled to facilitate the placement of additional casings into alignment with the casing string 65.

Figure 4:
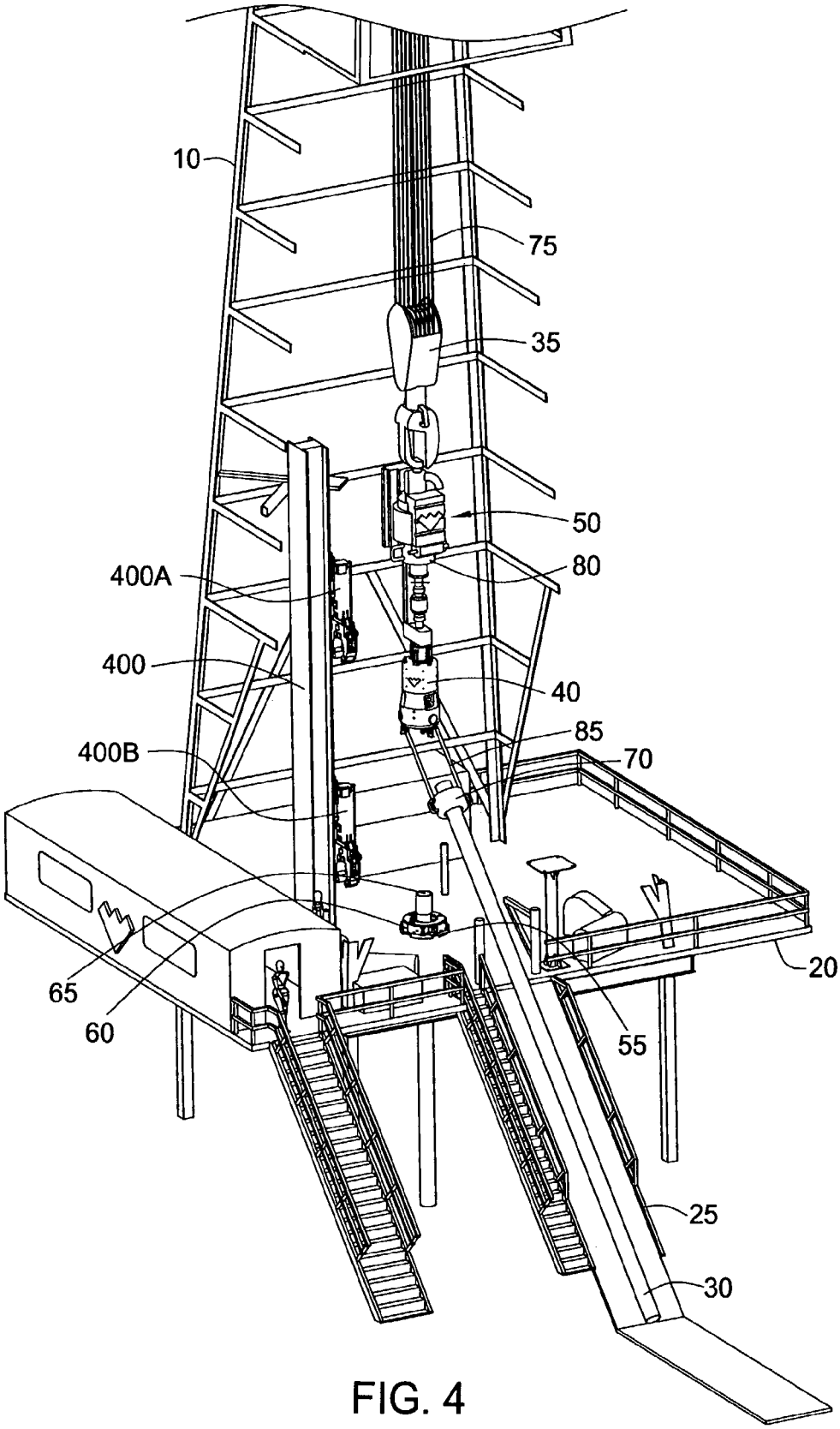
FIG. 4 is a partial view of another embodiment of a pipe handling arm disposed on a rig according to aspects of the present invention.

In another embodiment, one or more pipe handling arms 100 may be disposed on a rail 400 as illustrated in FIG. 4. Similar parts shown in FIG. 1 are similarly designated in FIGS. 4-6. As shown in FIG. 4, the rail 400 is disposed on the rig floor 20 with two pipe handling arms 400A, 400B disposed thereon. The rail 400 allows axial movement of the pipe handling arms 400A, 400B, as necessary. The arms 400A, 400B are positioned such that, during operation, one arm 400A grips an upper portion of the casing 30 while the other arm 400B grips a lower portion of the casing 30. In this respect, the arms 400A, 400B may be manipulated to optimally position the casing 30 for connection with the casing string 65.

Figure 5:
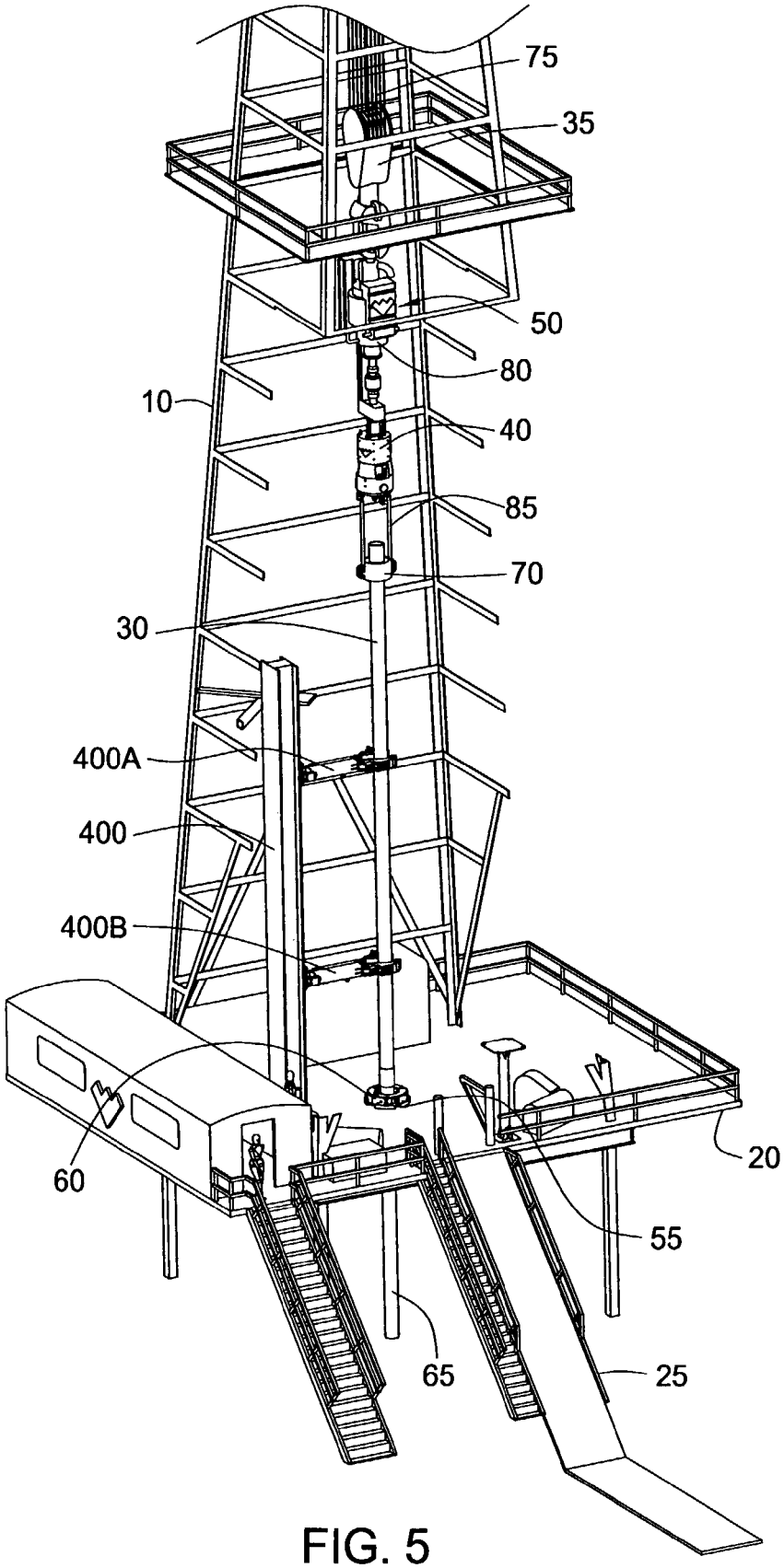
FIG. 5 is a partial view of the pipe handling arm of FIG. 4 after the casing has been stabbed into the casing string.
Figure 6:
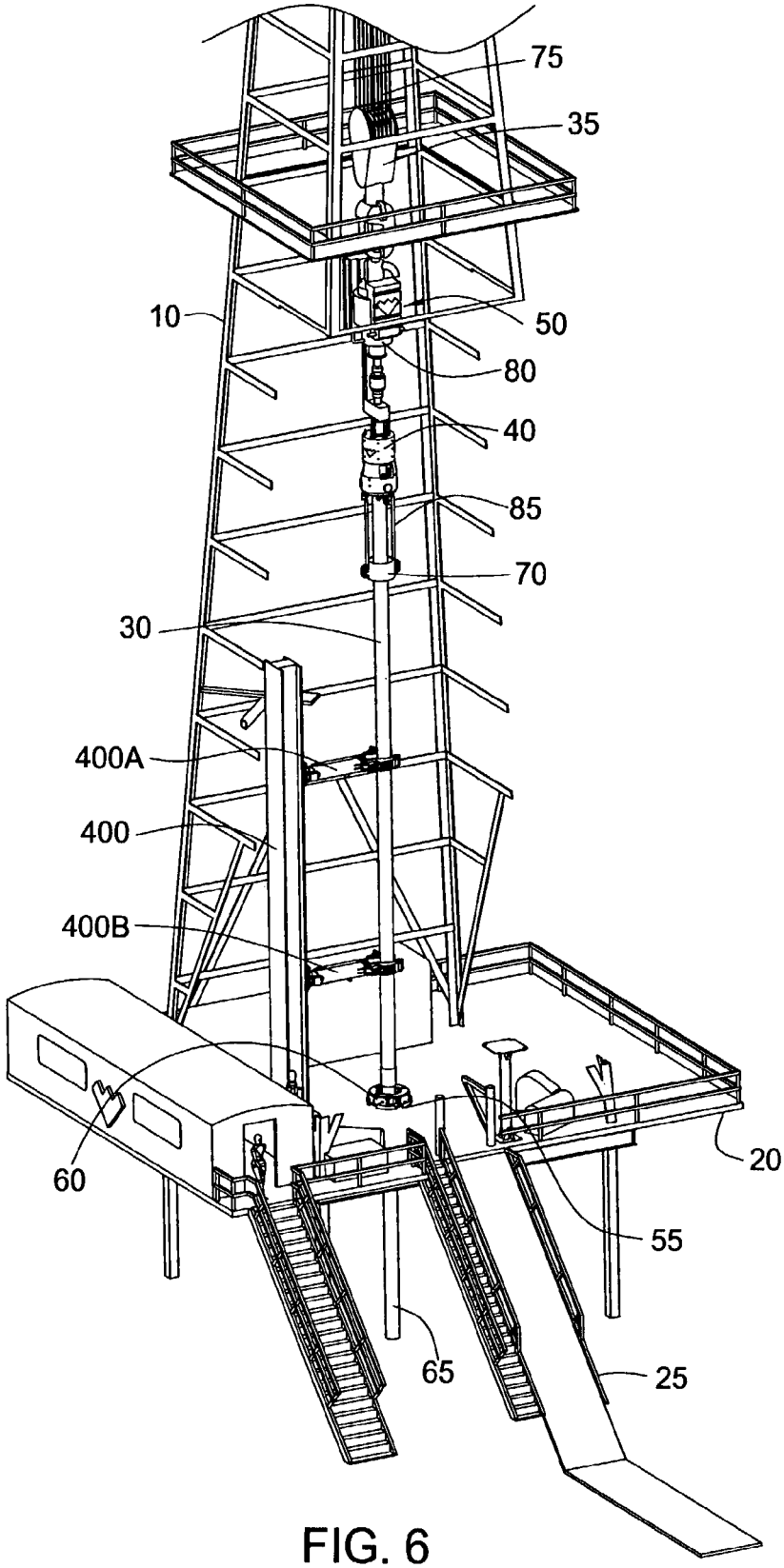
FIG. 6 is a partial view of the pipe handling arm of FIG. 4 after the torque head has engaged the casing.

FIGS. 4-6 show the pipe handling arms 400A, 400B in operation. In FIG. 4, the casing string 65, which was previously drilled into the formation (not shown) to form the wellbore (not shown), is shown disposed within the hole 55 in the rig floor 20. The casing string 65 may include one or more joints or sections of casing threadedly connected to one another. The casing string 65 is shown engaged by the spider 60. The spider 60 supports the casing string 65 in the wellbore and prevents the axial and rotational movement of the casing string 65 relative to the rig floor 20. As shown, a threaded connection of the casing string 65, or the box, is accessible from the rig floor 20.

In FIG. 4, the top drive 50, the torque head 40, and the elevator 70 are shown positioned proximate the rig floor 20. The casing 30 may initially be disposed on the rack 25, which may include a pick up/lay down machine. The elevator 70 is shown engaging an upper portion of the casing 30 and ready to be hoisted by the cables 75 suspending the traveling block 35. The lower portion of the casing 30 includes a threaded connection, or the pin, which may mate with the box of the casing string 65. At this point, the pipe handling arms 400A, 400B are shown in the unactuated position, where the arms 400A, 400B are substantially perpendicular to the rig floor 20.

While the casing 30 is being lifted by the traveling block 35, the pipe handling arms 400A, 400B shifts to the actuated position. The second piston and cylinder assembly 132 of each arm 400A, 400B may be actuated to move the respective telescopic arm 120 to a position parallel to the rig floor 20 as illustrated in FIG. 5. After the casing 30 is removed from the rack 25, it is placed into contact with at least one of the pipe handling arms 400A, 400B.

As shown, the casing 30 is positioned proximate the well center and engaged with arms 400A, 400B. The first arm 400A is shown engaged with an upper portion of the casing 30, while the second arm 400B is shown engaged with a lower portion of the casing 30. Particularly, the casing 30 is retained between jaws 154, 155 and in contact with rollers 164, 165, 171, 172. Each arm 400A, 400B may be individually manipulated to align the pin of the casing 30 to the box of the casing string 65. The arms 400A, 400B may be manipulated by actuating the first and third piston and cylinder assemblies 131, 133. Specifically, actuating the first piston and cylinder assembly 131 will move the gripping member 150 to the right or left with respect to the well center. Whereas actuating the third piston and cylinder assembly 133 will extend or retract the gripping member 150 with respect to the well center. In addition, the rotation counting member 180 is biased into contact with the casing 30 by the biasing member 184. After alignment, the pin is stabbed into the box by lowering the pin into contact with the box.

Thereafter, the spinner 170 is actuated to begin make up of the connection. Initially, torque from the motor 175 is transferred through the gear assembly 178 to the rotational members 171, 172. Because the rotational members 171, 172 are in frictional contact with the casing 30, the casing 30 is caused to rotate relative to the casing string 65, thereby initiating the threading of the connection. The rotation of the casing 30 causes the passive rollers 164, 165 to rotate, which facilitates the rotation of the casing 30 in the gripping member 150. At the same time, the rotation counting member 180 is also caused to rotate, thereby indicating that the connection is being made up. It is must noted that the casing 30 may be rotated by either one or both of the pipe handling arms 400A, 400B to make up the connection without deviating from the aspects of the present invention. After the connection is sufficiently made up, the rotational members 171, 172 are deactuated. In this manner, the initial make up of the connection may be performed by the spinner 170 in a shorter time frame than either the top drive or power tong. Additionally, because the pipe handling arm 100 is supporting the casing 30, the load on threaded connection is reduced as it is made up, thereby decreasing the potential for damage to the threads.

Next, the torque head 40 is lowered relative to the casing 30 and positioned around the upper portion of the casing 30. The slips of the torque head 40 are then actuated to engage the casing 30 as illustrated in FIG. 6. In this respect, the casing 30 is longitudinally and rotationally fixed with respect to the torque head 40. Optionally, a fill-up/circulating tool disposed in the torque head 40 may be inserted into the casing 30 to circulate fluid. After the torque head 40 grippingly engages the casing 30, the jaws 154, 155 of the pipe handling arms 400A, 400B are opened to release the casing 30. Thereafter, the pipe handling arms 400A, 400B are moved away from the well center by shifting back to the unactuated position. In this position, the top drive 50 may now be employed to complete the make up of the threaded connection. To this end, the top drive 50 may apply the necessary torque to rotate the casing 30 to complete the make up process. It is contemplated that a power tong may also be used to complete the make up process.

Although the above operations are described in sequence, it must be noted that at least some of the operations may be performed in parallel without deviating from aspects of the present invention. For example, the torque head 40 may complete the make up process while the pipe handling arms 400A, 400B are shifting to deactuated position. In another example, the torque head 40 may be positioned proximate the upper portion of the casing 30 simultaneously with the rotation of the casing 30 by the spinner 170. As further example, while the spinner 170 is making up the connection, the power tong may be moved into position for connecting the casings 30, 65. By performing some of the operations in parallel, valuable rig time may be conserved.

After the casing 30 and the casing string 65 are connected, the drilling with casing operation may begin. Initially, the spider 60 is released from engagement with the casing string 65, thereby allowing the new casing string 30, 65 to move axially or rotationally in the wellbore. After the release, the casing string 30, 65 is supported by the top drive 50. The drill bit disposed at the lower end of the casing string 30, 65 is urged into the formation and rotated by the top drive 50.

When additional casings are necessary, the top drive 50 is deactuated to temporarily stop drilling. Then, the spider 60 is actuated again to engage and support the casing string 30, 65 in the wellbore. Thereafter, the gripping head 40 releases the casing 30 and is moved upward by the traveling block 35. Additional strings of casing may now be added to the casing string using the same process as described above. In this manner, aspects of the present invention provide methods and apparatus to facilitate the connection of two tubulars.

After a desired length of wellbore has been formed, a cementing operation may be performed to install the casing string 30, 65 in the wellbore. In one embodiment, the drill bit disposed at the lower end of the casing string 30, 65 may be retrieved prior to cementing. In another embodiment, the drill bit may be drilled out along with the excess cement after the cement has cured.

In another aspect, the pipe handling arm 100 may be mounted on a spring loaded base 105. Generally, as the threaded connection is made up, the casing 30 will move axially relative to the casing string 65 to accommodate the mating action of the threads. The spring loaded base 105 allows the pipe handling arm 100 to move axially with the casing 30 to compensate for the mating action. In another embodiment, the pipe handling arm 100 may move axially along the rail 400 to compensate for the mating action.

In another aspect, the pipe handling arms 100 may be used to move a casing 30 standing on a pipe racking board on the rig floor 20 to the well center for connection with the casing string 65. In one embodiment, the arms 400A, 400B on the rail 400 may be manipulated to pick up a casing 30 standing on the rig floor 20 and place it above well center. After aligning the casings 30, 65, the pipe handling arms 400A, 400B may stab the casing 30 into the casing string 65. Then, the spinner 170 may be actuated to perform the initial make up. When the connection is ready for final make up, the torque head 40 is lowered into engagement with the casing 30. Thereafter, the top drive 50 may cause the torque head 40 to rotate the casing 50 to complete the make up process. It is envisioned that the pipe handling arms 400A and 400B may retain the casing 30 while it is being made up by the top drive 50. In this respect, the rollers 164, 165, 171, 172 act as passive rollers, thereby facilitating rotation of the casing 30.

While the foregoing is directed to embodiments of the present invention, other and further embodiments of the invention may be devised without departing from the basic scope thereof, and the scope thereof is determined by the claims that follow.

We claim:

1. A method of connecting a first tubular to second tubular, comprising:

disposing a gripping member on a derrick, the gripping member having two adjustable jaws configured to accommodate varying tubular diameters and at least one drive roller;

engaging the first tubular using the gripping member connected to a conveying member;

moving the gripping member and the engaged first tubular to align the first tubular with the second tubular;

determining a position of the gripping member, wherein the position of the gripping member aligns the first tubular with the second tubular;

memorizing the position of the gripping member;

engaging the first tubular with the second tubular;

rotating the first tubular relative to the second tubular using the at least one drive roller, wherein:

the first tubular moves along an axis thereof during rotation, the gripping member is disposed on a rail, and the gripping member moves along the axis with the first tubular by being moved alone the rail during rotation of the first tubular; and rotating the first tubular relative to the second tubular using a top drive until the connection is complete.

2. The method of claim 1, further comprising recalling the memorized position to position a third tubular.

3. The method of claim 1, wherein moving the gripping member comprises actuating the conveying member.

4. The method of claim 1, wherein the at least one drive roller rotates the first tubular relatively faster than a top drive.

5. The method of claim 1, further comprising making up about 80% or less of a connection between the first tubular and the second tubular.

6. The method of claim 1, further comprising detecting a rotation of the first tubular.

7. The method of claim 6, further comprising providing a rotation counting member to detect the rotation of the first tubular.

8. The method of claim 1, further comprising placing the conveying member at an inclined position relative to a horizontal plane.

9. The method of claim 1, wherein the at least one drive roller comprises a motor and one or more rotational members for engaging the first tubular.

10. The method of claim 1, further comprising biasing a rotation counting member against the first tubular.

11. The method of claim 1, wherein the gripping member is remotely controllable.

12. The method of claim 1, wherein the conveying member comprises a telescopic arm.

13. The method of claim 12, wherein the telescopic arm is mounted on a rotor which is pivotally mounted on a base.

14. The method of claim 1, wherein the gripping member is non-rotatable relative to the conveying member.

15. The method of claim 1, wherein the first tubular is rotated in an opposite direction of the at least one drive roller.

16. The method of claim 1, wherein 80% or less of the connection is made up using the gripping member.

17. A method of connecting a first tubular to second tubular, comprising:

disposing a gripping member on a derrick, the gripping member having two adjustable jaws configured to accommodate varying tubular diameters and at least one drive roller;

engaging the first tubular using the gripping member connected to a conveying member;

moving the gripping member and the engaged first tubular to align the first tubular with the second tubular;

determining a position of the gripping member, wherein the position of the gripping member aligns the first tubular with the second tubular;

memorizing the position of the gripping member;

engaging the first tubular with the second tubular;

rotating the first tubular relative to the second tubular using the at least one drive roller, wherein:

the first tubular moves along an axis thereof during rotation, the gripping member is mounted on a spring loaded base, and the base accommodates movement of the gripping member along the axis with the first tubular during rotation of the first tubular; and rotating the first tubular relative to the second tubular using a top drive until the connection is complete.

* * * * *

UNITED STATES PATENT AND TRADEMARK OFFICE

CERTIFICATE OF CORRECTION

PATENT NO. : 7,509,722 B2
APPLICATION NO. : 10/382353
DATED : March 31, 2009
INVENTOR(S) : Shahin et al.

It is certified that error appears in the above-identified patent and that said Letters Patent is hereby corrected as shown below:

On the title page, in the Related U.S. Application Data (63):

Please delete "Continuation-in-part of application No. 09/486,901, filed as application No. PCT/GB98/02582 on Sep. 2, 1998, now Pat. No. 6,591,471." and insert --Continuation-in-part of application No. 09/486,901, filed on May 19, 2000, now Pat. No. 6,591,471, which is the National Stage of International Application No. PCT/GB98/02582, filed on Sep. 2, 1998.-- therefore;

On the title page, in the References Cited (56):

Please delete "2,105,885 A 1/1938 Hindertiter" and insert --2,105,885 A 1/1938 Hinderliter-- therefor;

Please delete "2,538,458 A1/1951 Munsinger";

Please delete "5,197,553 A 3/1993 Letumo" and insert --5,197,553 A 3/1993 Leturno-- therefor;

Please delete "WO 88/01651 1/1998" and insert --WO 98/01651 1/1998-- therefor;

Please delete "U.S. Appl. No. 10/755,048, filed Feb. 9, 2004." and insert --U.S. Appl. No. 10/775,048, filed Feb. 9, 2004.-- therefor;

Please delete "U.S. Appl. No. 10/775,048, filed Feb. 2, 2004." and insert --U.S. Appl. No. 10/772,217, filed Feb. 2, 2004.-- therefor;

In the Claims:

Column 10, Claim 1, Line 58, please delete "alone" and insert --along-- therefor.

Signed and Sealed this

Fourteenth Day of September, 2010

David J. Kappos

David J. Kappos
*Director of the United States Patent and Trademark Office*